US009903366B2

(12) United States Patent
Kido

(10) Patent No.: US 9,903,366 B2
(45) Date of Patent: Feb. 27, 2018

(54) VARIABLE DISPLACEMENT VANE PUMP

(71) Applicant: HITACHI AUTOMOTIVE SYSTEMS STEERING, LTD., Saitama (JP)

(72) Inventor: Yoshiaki Kido, Atsugi (JP)

(73) Assignee: HITACHI AUTOMOTIVE SYSTEMS STEERING, LTD., Saitama (JP)

( * ) Notice: Subject to any disclaimer, the term of this patent is extended or adjusted under 35 U.S.C. 154(b) by 368 days.

(21) Appl. No.: 14/619,617

(22) Filed: Feb. 11, 2015

(65) Prior Publication Data

US 2015/0260186 A1 Sep. 17, 2015

(30) Foreign Application Priority Data

Mar. 14, 2014 (JP) ..... 2014-052436

(51) Int. Cl.

| | |
|---|---|
| ***F04C 2/344*** | (2006.01) |
| ***F04C 14/22*** | (2006.01) |
| ***F01C 21/10*** | (2006.01) |
| ***F04C 15/00*** | (2006.01) |
| ***F04C 15/06*** | (2006.01) |

(52) U.S. Cl.

CPC ..... *F04C 2/344* (2013.01); *F04C 14/226* (2013.01); *F01C 21/108* (2013.01); *F04C 15/0034* (2013.01); *F04C 15/06* (2013.01)

(58) Field of Classification Search

CPC ..... F04C 14/226; F04C 15/0034

See application file for complete search history.

(56) References Cited

U.S. PATENT DOCUMENTS 4,678,412 A * 7/1987 Dantlgraber ..... F04C 14/226 417/220

FOREIGN PATENT DOCUMENTS

JP 2012-087777 A 5/2012
WO WO 2015097637 A1 * 7/2015 ..... F04C 14/226

* cited by examiner

*Primary Examiner* — Mary A Davis
(74) *Attorney, Agent, or Firm* — Foley & Lardner LLP

(57) ABSTRACT

A variable displacement vane pump includes first and second sealing grooves formed on an intake port side and separated away from each other in a circumferential direction; first and second sealing members provided in the first and second sealing grooves; a first fluid-pressure chamber formed on a side on which a volume thereof decreases when the cam ring moves to a side on which an eccentricity of the cam ring increases; and a second fluid-pressure chamber formed on a side on which a volume thereof increases when the cam ring moves to a side on which the eccentricity of the cam ring increases; and a control valve configured to control the pressure in the first or second fluid-pressure chamber.

12 Claims, 9 Drawing Sheets

VARIABLE DISPLACEMENT VANE PUMP

TECHNICAL FIELD

The present invention relates to a variable displacement vane pump capable of changing a delivery capacity.

BACKGROUND

Hitherto, the following variable displacement vane pump is known. Specifically, the variable displacement vane pump includes vanes received in slot grooves of a rotor so as to be projectable therefrom and retractable therein. Pump chambers are defined by an inner circumferential surface of a cam ring, an outer circumferential surface of the rotor, and the vanes. Volumes of the pump chambers are changed by a swing of the cam ring. For example, a vane pump described in Japanese Patent Application Laid-open No. 2012-87777 includes a solenoid for applying a biasing force to a control valve for controlling an eccentricity of the cam ring so that a delivery flow rate becomes equal to a desired value. Through the application of a predetermined biasing force using the solenoid, the delivery flow rate is controlled.

In the vane pump described in Japanese Patent Application Laid-open No. 2012-87777, however, in a case where a magnitude relationship between a pressure in a first control chamber and a pressure in a second control chamber frequently changes, there is a fear in that a sealing member undesirably moves horizontally to lower durability of an edge portion of the sealing member. Further, if a volume of the first control chamber or the second control chamber is fluctuated due to the swing of a cam ring 8, the pressure is further fluctuated. Therefore, the phenomenon of the horizontal movement of the sealing member becomes further noticeable. Further, if a leakage occurs from a sealed portion in a state in which an absolute pressure in the first control chamber or the second control chamber is high, cavitation erosion occurs due to air contained in operating oil. In order to avoid the occurrence of cavitation erosion, it is conceivable to select a material having a high hardness and a high strength as a material of the sealing member. If such a material is used, however, when the sealing member moves due to a fluctuation in differential pressure between the first control chamber and the second control chamber, there is a fear in that an adapter ring on which the sealing member is provided may be struck to lower durability of the adapter ring.

SUMMARY

In order to achieve the above-mentioned object, according to one embodiment of the present invention, there is provided a variable displacement vane pump, including: a pair of sealing grooves formed on a pump-element housing portion so as to have openings opposed to an outer circumferential surface of a cam ring in a radial direction of a rotation axis of a driving shaft, the pair of sealing grooves including a first sealing groove and a second sealing groove formed on an intake port side with respect to the driving shaft so as to be separated away from each other in a circumferential direction; a pair of sealing members including a first sealing member provided in the first sealing groove and a second sealing member provided in the second sealing groove; a pair of pressure chambers formed between the pump-element housing portion and the cam ring in the radial direction so as to be separated by the first sealing member and the second sealing member, the pair of pressure chambers including: a first fluid-pressure chamber formed on a side on which a volume thereof decreases when the cam ring moves to a side on which an eccentricity of the cam ring increases, the first fluid-pressure chamber being configured such that a delivery pressure delivered through a delivery port is introduced; and a second fluid-pressure chamber formed on a side on which a volume thereof increases when the cam ring moves to a side on which the eccentricity of the cam ring increases, the second fluid-pressure chamber being configured such that the delivery pressure delivered through the delivery port is introduced; and a control valve configured to control a pressure in the first fluid-pressure chamber or the second fluid-pressure chamber.

Thus, both circumferential sides of each of the first sealing member and the second sealing member are not adjacent to both of the first fluid-pressure chamber and the second fluid-pressure chamber. Therefore, the movement of the first and second sealing members, which is caused along with a change in pressure in the first fluid-pressure chamber or the second fluid-pressure chamber along with a vibration of the cam ring, is suppressed to prevent the sealing members and the sealing grooves from being damaged.

DESCRIPTION OF EMBODIMENTS

First Embodiment

<Overview of Vane Pump>

An overview of a vane pump 1 according to a first embodiment of the present invention is described. The vane pump 1 is used as a hydraulic-pressure supply source for a hydraulic actuator for an automobile. Specifically, the vane pump 1 is used as a hydraulic-pressure supply source for a belt-type continuously variable transmission (CVT). The vane pump 1 may also be used as a hydraulic-pressure supply source for other hydraulic actuators such as a power steering system. The vane pump 1 is driven by a crankshaft of an internal combustion engine so as to take in and deliver a working fluid. As the hydraulic fluid, operating oil, more specifically, CVT oil is used. The operating oil has a relatively large elastic modulus and has property of greatly changing its pressure in response to a slight change in volume. The vane pump 1 is a variable displacement vane pump that is capable of varying a delivery capacity (fluid amount delivered for one revolution; hereinafter referred to as "pump capacity"). The vane pump 1 includes a pump section 2 and a control section 3 as an integrated unit. The pump section 2 takes in and delivers the working fluid. The control section 3 controls the delivery capacity.

<Configuration of Pump Section>

Figure 1:
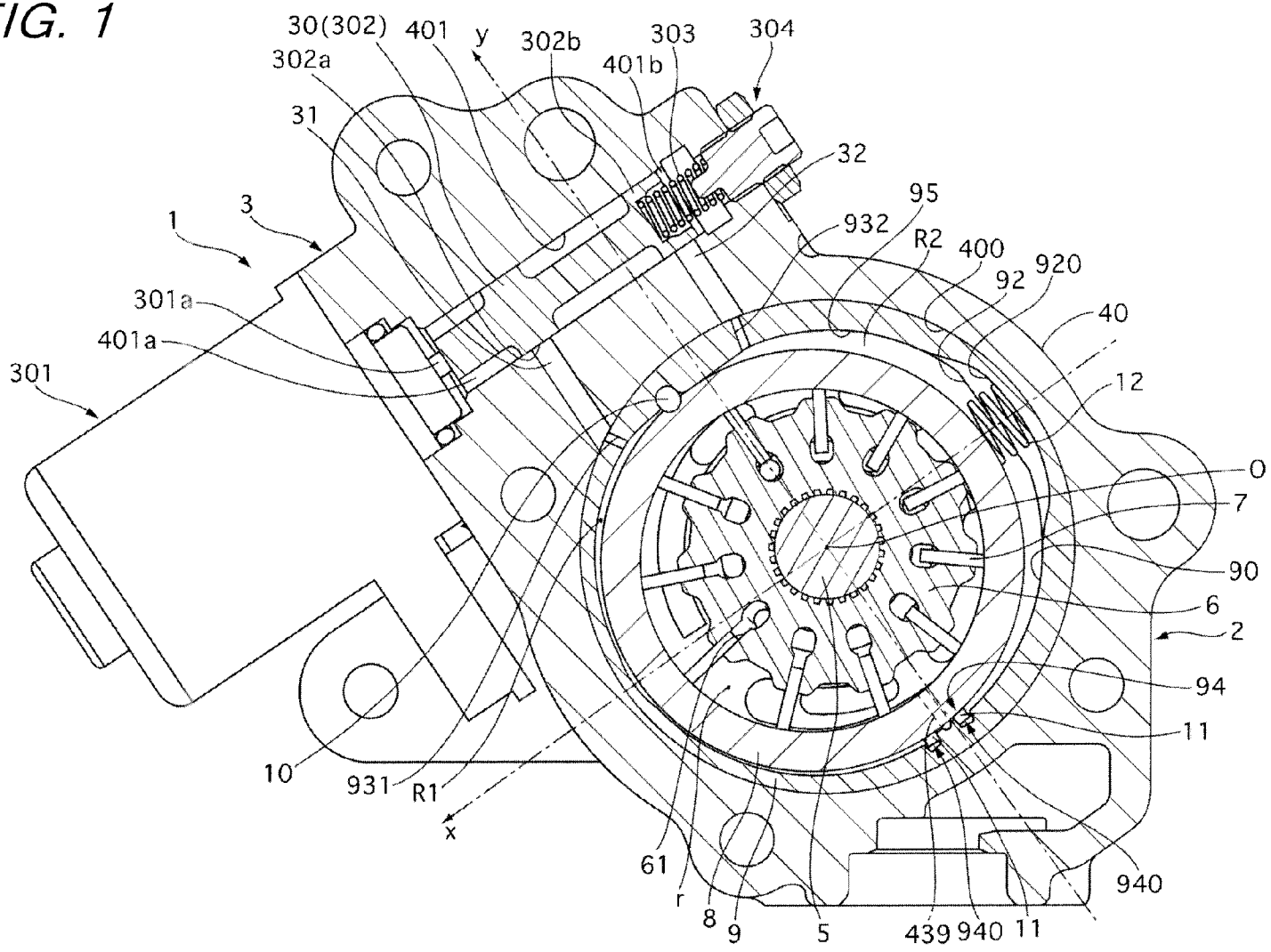
FIG. 1 is a sectional view illustrating interior of a vane pump according to a first embodiment of the present invention, as viewed in a direction of a rotation axis.

FIG. 1 is a partial sectional view illustrating interior of the vane pump 1 as viewed in a direction of a rotation axis. For convenience of description, a three-dimensional Cartesian coordinate system is provided. An x axis and a y axis are set in a radial direction of the vane pump 1, whereas a z axis is set in the direction of the rotation axis of the vane pump 1. Specifically, the z axis is provided on a rotation axis O of the vane pump 1, the x axis is provided in a direction in which a center axis P of a cam ring 8 swings with respect to the rotation axis O, and the y axis is provided in a direction orthogonal to the x axis and the z axis. An upward direction with respect to the drawing sheet of FIG. 1 is set as a positive z-axis direction. A direction in which the center axis P is away from the rotation axis O (toward a side on which a first confinement region is provided with respect to a second confinement region; see FIG. 2) is set as a positive x-axis direction. A direction toward a delivery region with respect to an intake region is set as a positive y-axis direction.

The pump section 2 includes, as main components, a driving shaft 5, a rotor 6, a plurality of vanes 7, a cam ring 8, an adapter ring 9, a pressure plate 41, a rear body 40, and a front body 42. The driving shaft 5 is driven by the crankshaft. The rotor 6 is rotationally driven by the driving shaft 5. The vanes 7 are respectively received in a plurality of slots 61 formed on an outer circumferential surface of the rotor 6 so as to be projectable therefrom and retractable therein. The cam ring 8 is provided so as to surround the rotor 6. The adapter ring 9 is provided so as to surround the cam ring 8. The pressure plate 41 is provided on an axial side surface of the cam ring 8 and that of the rotor 6 so as to form a plurality of pump chambers r in cooperation with the cam ring 8, the rotor 6, and the vanes 7. The rear body 40 includes a housing hole 400. On a bottom portion of the housing hole 400, the pressure plate 41 is housed. Inside the housing hole 400, the adapter ring 9, the cam ring 8, the rotor 6, and the vanes 7 are housed. The front body 42 closes the housing hole 400 of the rear body 40 and forms the plurality of pump chambers r in cooperation with the cam ring 8, the rotor 6, and the vanes 7. The rear body 40 and the front body 42 are collectively referred to as "pump housing".

<Configuration of Adapter Ring>

Figure 2:
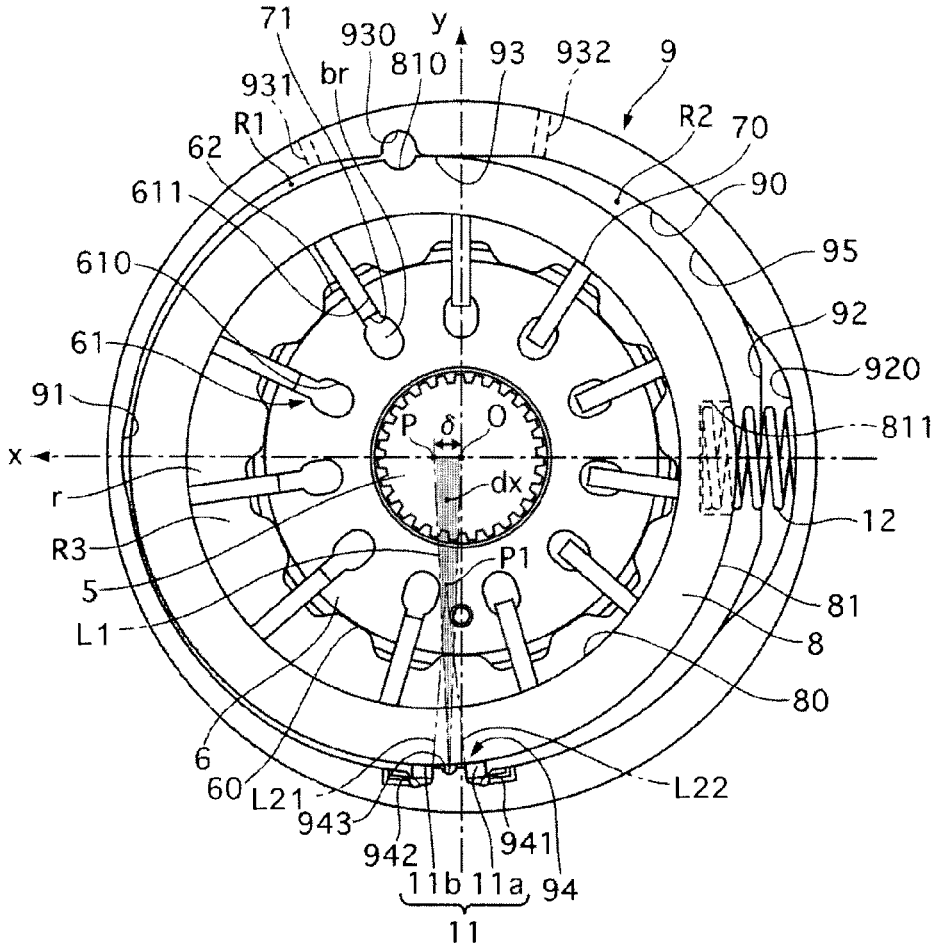
FIG. 2 is a partial enlarged view illustrating an internal configuration of an adapter ring according to the first embodiment.

FIG. 2 is a partial enlarged view of an internal configuration of the adapter ring 9 according to the first embodiment. The rear body 40 has the housing hole 400 having an approximately cylindrical shape, which extends in the z-axis direction. In the housing hole 400, the adapter ring 9 having an annular shape is provided.

An inner circumferential surface of the adapter ring 9 forms a housing hole 90 having an approximately cylindrical shape, which extends in the z-axis direction. On the positive x-axis side of the housing hole 90, a first plane portion 91 that is approximately parallel to a yz plane is formed. On the negative x-axis side of the housing hole 90, a second plane portion 92 that is approximately parallel to the yz plane is formed. On the negative x-axis side, a level-difference portion 920 is formed in approximately the center of the second plane portion 92 in the z-axis direction.

On the positive y-axis side of the housing hole 90 and slightly closer to the positive x-axis side with respect to the rotation axis O, a third plane portion 93 that is approximately parallel to the z axis is formed. On the third plane portion 93, a groove (concave portion 930) having a semi-circular shape as viewed in the z-axis direction is formed. On both sides of the concave portion 930, communication paths 931 and 932, each radially passing through the adapter ring 9, are formed. At a position on the third plane portion 93, which is located on the positive x-axis side with respect to the concave portion 930, the first communication path 931 has an opening. At a position on the third plane portion 93, which is located on the negative x-axis side with respect to the concave portion 930, the second communication path 932 has an opening. On the negative y-axis side of the housing hole 90, a fourth plane portion 94 that is approximately parallel to an xz plane is formed. On the fourth plane portion 94, a pair of a first sealing groove 941 and a second sealing groove 942, each having a rectangular shape as viewed in the z-axis direction, are formed.

<Configuration of Cam Ring>

Inside the housing hole 90 of the adapter ring 9, the cam ring 8 having the annular shape is provided so as to be swingable. In other words, the adapter ring 9 is provided so as to surround the cam ring 8. An inner circumferential surface 80 and an outer circumferential surface 81 of the cam ring 8 are generally circular as viewed in the z-axis direction. A radial width of the cam ring 8 is approximately constant. At a position on the outer circumferential surface 81 of the cam ring 8, which is located on the positive y-axis side, a groove (concave portion 810) having a semi-circular shape as viewed in the z-axis direction is formed.

At a position on the outer circumferential surface 81 of the cam ring 8, which is located on the negative x-axis side, a concave portion 811 having a generally cylindrical shape, which has an axis in the x-axis direction, is formed by drilling to have a predetermined depth. At a position between the concave portion 930 formed on the inner circumferential surface 95 of the adapter ring 9 and the concave portion 810 formed on the outer circumferential surface 81 of the cam ring 8, a pin 10 (see FIG. 1) extending in the z-axis direction is provided so as to be held in contact with the concave portions 930 and 810 and interposed between the concave portions 930 and 810.

In the concave portion 440 (the first sealing groove 941 and the second sealing groove 942) formed on the inner circumferential surface 95 of the adapter ring 9 described above, sealing members 11 are provided. The sealing members 11 include a first sealing member 11*a* and a second sealing member 11*b*. The sealing members 11 are held in contact with a portion of the outer circumferential surface 81 of the cam ring 8, which is located on the negative y-axis side.

In the level-difference portion 920 provided on the inner circumferential surface 95 of the adapter ring 9, one end of a spring 12 as an elastic member is provided. The spring 12 is a coil spring. Into the concave portion 811 formed on the outer circumferential surface 81 of the cam ring 8, another end of the spring 12 is inserted. The spring 12 is provided in a compressed state and constantly biases the cam ring 8 in the positive x-axis direction against the adapter ring 9.

A dimension of the housing hole 90 of the adapter ring 9 in the x-axis direction, that is, a distance between the first plane portion 91 and the second plane portion 92 is set so as to be larger than a diameter of the outer circumferential surface 81 of the cam ring 8. The cam ring 8 is supported on the third plane portion 93 with respect to the adapter ring 9 and is provided so as to be swingable in the xy plane about the third plane portion 93 as a fulcrum. The pin 10 suppresses a positional shift (relative rotation) of the cam ring 8 with respect to the adapter ring 9.

The swing of the cam ring 8 is restricted by the contact of the outer circumferential surface 81 of the cam ring 8 with the first plane portion 91 of the adapter ring 9 on the positive x-axis side and by the contact of the outer circumferential surface 81 of the cam ring 8 with the second plane portion 92 of the adapter ring 9 on the negative x-axis side. An eccentricity of the center axis P of the cam ring 8 with respect to the rotation axis O is assumed as δ. At a position at which the outer circumferential surface 81 of the cam ring 8 comes into contact with the second plane portion 92 (minimum eccentricity position), the eccentricity δ has a minimum value. At a position illustrated in FIG. 2, at which the outer circumferential surface 81 of the cam ring 8 comes into contact with the first plane portion 91 (maximum eccentricity position), the eccentricity δ has a maximum value. When the cam ring 8 swings, the third plane portion 93 comes into sliding contact with the outer circumferential surface 81 of the cam ring 8, while the first sealing member 11*a* provided in the first sealing groove 941 and the second sealing member 11*b* provided in the second sealing groove 942 come into sliding contact with the outer circumferential surface 81 of the cam ring 8.

<Configuration of Control-Pressure Chambers>

A space between the inner circumferential surface 95 of the adapter ring 9 and the outer circumferential surface 81 of the cam ring 8 is sealed by the pressure plate 41 on the negative z-axis side and by the front body 42 on the positive z-axis side. At the same time, the above-mentioned space is partitioned into two control-pressure chambers R1 and R2 in a liquid-tight fashion by the third plane portion 93, the first sealing member 11*a*, and the second sealing member 11*b*.

The first control-pressure chamber R1 is formed on the positive x-axis side, whereas the second control-pressure chamber R2 is formed on the negative x-axis side. The first communication path 931 has the opening oriented toward the first control-pressure chamber R1, whereas the second communication path 932 has the opening oriented toward the second control-pressure chamber R2. A predetermined gap is ensured between the outer circumferential surface 81 of the cam ring 8 and the inner circumferential surface 95 of the adapter ring 9 when the outer circumferential surface 81 of the cam ring 8 is in the above-mentioned restriction position. Therefore, a volume of each of the first control-pressure chamber R1 and the second control-pressure chamber R2 is a predetermined volume or larger and does not become zero.

<Configuration of Rotor>

The driving shaft 5 is rotatably supported by a body (the rear body 40, the pressure plate 41, and the front body 42). The driving shaft 5 is coupled to the crankshaft of the internal combustion engine through an intermediation of a chain so as to rotate in synchronization with the rotation of the crankshaft. The rotor 6 is fixed (spline-coupled) coaxially onto an outer circumferential surface of the driving shaft 5. The rotor 6 is generally columnar and is provided on the inner circumferential side of the cam ring 8. In other words, the cam ring 8 is provided so as to surround the rotor 6. In a space surrounded by an outer circumferential surface 60 of the rotor 6, the inner circumferential surface 80 of the cam ring 8, the pressure plate 41, and the front body 42, an annular chamber R3 is formed. The rotor 6 rotates with the driving shaft 5 about the rotation axis O in a clockwise direction in FIG. 2.

The plurality of grooves (slots 61) are formed radially on the rotor 6. Each of the slots 61 is formed linearly so as to extend in the radial direction of the rotor 6 (hereinafter referred to as "rotor radial direction") from the outer circumferential surface 60 of the rotor 6 toward the rotation axis O by a predetermined depth, as viewed in the z-axis direction. The slots 61 are formed over the entire range of the rotor 6 in the z-axis direction. The slots 61 are formed at eleven positions that equally divide the rotor 6 in a circumferential direction.

The vanes 7 are plate members (blades), each having a generally rectangular shape. A plurality of (eleven) vanes 7 are provided. Each one of the vanes 7 is provided so as to be projectable from each of the slots 61. A distal end portion (vane distal end portion 70) of each of the vanes 7 on the rotor outer-diameter side (on the side away from the rotation axis O) is formed so as to have a gently curved surface corresponding to the inner circumferential surface 80 of the cam ring 8. The number of slots 61 and the number of vanes 7 are not limited to eleven.

An end portion (slot proximal end portion 610) of each of the slots 61 on the rotor inner-diameter side (on the side closer to the rotation axis O) is formed so as to have a generally cylindrical shape. The slot proximal end portion 610 is generally circular with a larger diameter than a width of a slot main body portion 611 in the rotor circumferential direction, as viewed in the z-axis direction. The slot proximal end portion 610 is not particularly required to be formed so as to have the cylindrical shape, and may be formed so as to have, for example, a groove-like shape similar to that of the slot main body portion 611. At a position between the slot proximal end portions 610 and rotor inner-diameter side end portions (vane proximal end portions 71) of the vanes 7 received in the slots 61, back-pressure chambers br (pressure-receiving portions) of the vanes 7 are formed.

At a position on the outer circumferential surface 60 of the rotor 6, which corresponds to each of the vanes 7, a projecting portion 62 having a generally trapezoidal shape, as viewed in the z-axis direction is provided. The projecting portions 62 are formed so as to project from the outer circumferential surface 60 of the rotor 6 to a predetermined height over the entire range of the rotor 6 in the z-axis direction. At an approximately central position of the projecting portion 62, an opening portion of each of the slots 61 is formed. A length of each of the slots 61 in the rotor radial direction (including the projecting portion 62 and the slot proximal end portion 610) is approximately the same as a length of each of the vanes 7 in the rotor radial direction.

By providing the projecting portions 62, a predetermined length or larger of the slots 61 in the rotor radial direction is ensured. Therefore, for example, even if one of the vanes 7 projects from the corresponding slot 61 by a maximum amount in the first confinement region described later, the retention of the vane 7 in the slot 61 is ensured. In other words, the retention of the vanes 7 is improved by the projecting portions 62, while a thickness other than that of the projecting portions 62 is eliminated on the outer circumferential surface 60 of the rotor 6. Therefore, the volumes of the pump chambers r are increased by the eliminated thickness so as to improve pump efficiency. In addition, the whole rotor 6 is reduced in weight so as to reduce a power loss.

The annular chamber R3 is partitioned into the plurality of (eleven) pump chambers (volume chambers) r by the plurality of vanes 7. A distance between the adjacent vanes 7 (between side surfaces of the two vanes 7) in a rotating direction of the rotor 6 (hereinafter referred to simply as "rotating direction") is hereinafter referred to as "one pitch". A width of one of the pump chambers r in the rotating direction is one pitch. A length of one pitch is not required to be uniform.

In a state in which the center axis P of the cam ring 8 is eccentrically located (on the positive x-axis side) with respect to the rotation axis O, a distance between the outer circumferential surface 60 of the rotor 6 and the inner circumferential surface 80 of the cam ring 8 in the rotor radial direction (radial dimension of each of the pump chambers r) becomes larger as a position at which the distance is measured moves in the positive x-axis direction. In accordance with the change in distance, the vanes 7 project from the slots 61 so as to form the pump chambers r. At the same time, the volumes of the pump chambers r on the positive x-axis side become larger than those on the negative x-axis side. By a difference between the volumes of the pump chambers r, on the negative y-axis side of the x axis as a boundary, the volume of each of the pump chambers r becomes larger as the position in the pump chamber r becomes closer to the x axis in the positive x-axis direction that is a positive rotating direction of the rotor 6 (clockwise direction in FIG. 2). On the other hand, on the positive y-axis side of the x axis as the boundary, the volume of each of the pump chambers r becomes smaller as the position in the pump chamber r becomes closer to the x axis in the negative x-axis direction that is the positive rotating direction of the rotor 6.

<Configuration of Pressure Plate>

Figure 3:
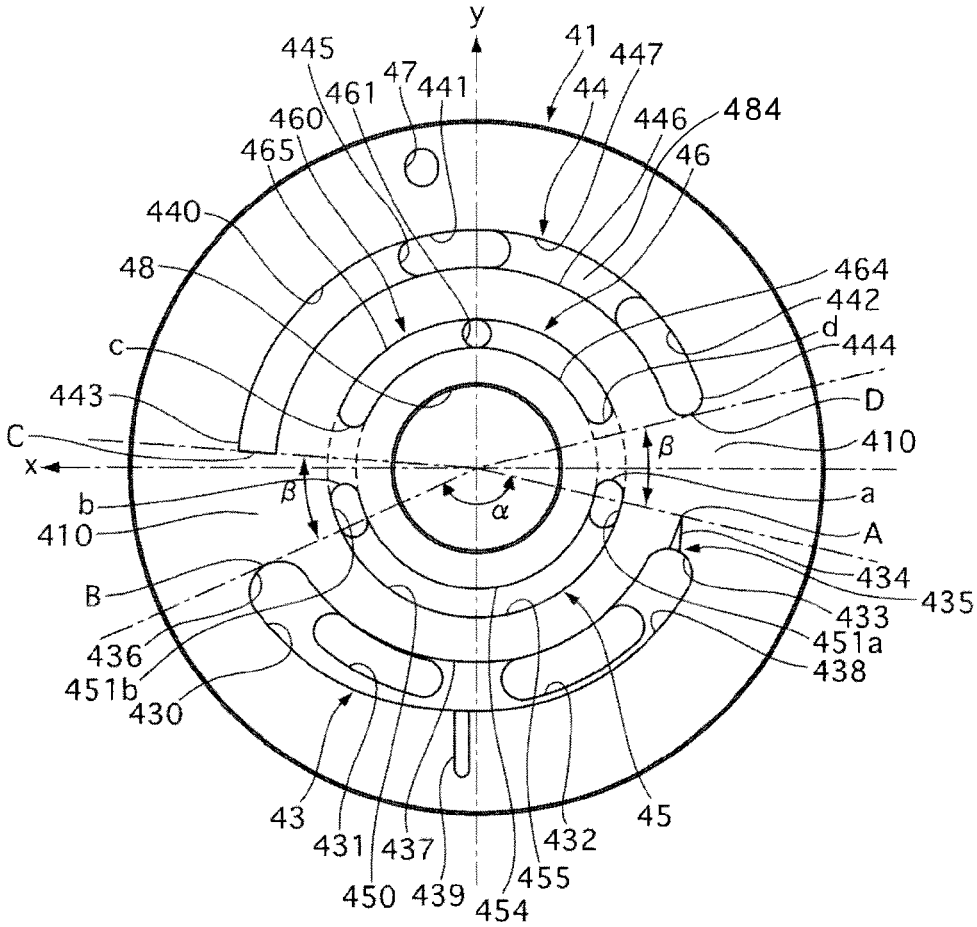
FIG. 3 is a plan view illustrating a pressure plate according to the first embodiment, as viewed from the positive z-axis direction side.

FIG. 3 is a plan view illustrating the pressure plate 41 according to the first embodiment as viewed from the positive z-axis direction. An intake port 43, a delivery port 44, an intake-side back-pressure port 45, a delivery-side back-pressure port 46, a pin fixing hole 47, and a through hole 48 are formed in the pressure plate 41. The pin 10 is inserted into the pin fixing hole 47 so as to be fixed therein. The driving shaft 5 is inserted into the through hole 48 so as to be provided rotatably therein.

<Configuration of Intake Port>

The intake port 43 is a portion serving as an inlet for introducing the operating oil into the pump chambers r located on the intake side from exterior. The intake port 43 is formed in a portion on the negative y-axis side, on which the volumes of the pump chambers r increase in accordance with the rotation of the rotor 6. The intake port 43 includes an intake-side arc-shaped groove 430 and intake holes 431 and 432. The intake-side arc-shaped groove 430 is formed on a surface 410 of the pressure plate 41 on the positive z-axis side and is a groove into which a hydraulic pressure on the pump intake side is introduced. The intake-side arc-shaped groove 430 is formed so as to have a generally arc-like shape about the rotation axis O along the arrangement of the pump chambers r on the intake side.

In an angular range corresponding to the intake-side arc-shaped groove 430, specifically, a range of an angle $\alpha$ corresponding to about 4.5 pitches, which is formed between a starting point A of the intake-side arc-shaped groove 430 located on the negative x-axis side with respect to the rotation axis O and an end point B located on the positive x-axis side with respect to the rotation axis O, an intake region of the vane pump 1 is provided.

A terminal end portion 436 of the intake-side arc-shaped groove 430 is formed so as to have a generally semi-circular arc-like shape that is convex in the positive rotating direction. A starting end portion 435 of the intake-side arc-shaped groove 430 includes a main-body starting end portion 433 and a notch 434. The main-body starting end portion 433 is formed so as to have a generally semi-circular arc-like shape that is convex in a negative rotating direction (counterclockwise direction in FIG. 2). The notch 434 is formed continuously with the main-body starting end portion 433. The notch 434 is formed so as to have a length equal to about 0.5 pitches so as to extend from the main-body starting end portion 433 in the negative rotating direction. A distal end portion of the notch 434 coincides with the starting point A. A width of the intake-side arc-shaped groove 430 in the rotor radial direction is provided so as to be approximately equal over the entire range in the positive rotating direction and is approximately equal to a width of the annular chamber R3 in the rotor radial direction when the cam ring 8 is located in the minimum eccentricity position (see FIG. 2).

An edge 437 of the intake-side arc-shaped groove 430 on the rotor inner-diameter side is located slightly away from the outer circumferential surface 60 of the rotor 6 (except for the projecting portions 62) to the rotor outer-diameter side. An edge 438 of the intake-side arc-shaped groove 430 on the rotor outer-diameter side is located slightly away from the inner circumferential surface 80 of the cam ring 8 to the rotor outer-diameter side when the cam ring 8 is located in the minimum eccentricity position. On a terminal end side of the edge 438, the edge 438 is located slightly away from the inner circumferential surface 80 of the cam ring 8 to the rotor outer-diameter side when the cam ring 8 is located in the maximum eccentricity position. Each of the pump chambers r on the intake side overlaps the intake-side arc-shaped groove 430 as viewed in the z-axis direction and is held in communication to the intake-side arc-shaped groove 430 regardless of the eccentric position of the cam ring 8.

In approximately the center of the intake-side arc-shaped groove 430 in the rotating direction, the intake hole 431 is formed. The intake hole 431 has a generally elliptical shape as viewed in the z-axis direction. The intake hole 431 has a smaller width in the rotor radial direction than that of the intake-side arc-shaped groove 430 and has a length in the rotating direction equal to about one pitch. The intake hole 431 passes through the pressure plate 41 in the z-axis direction and is formed at a position overlapping the y axis.

In the intake-side arc-shaped groove 430, the intake hole 432 is formed adjacent to the intake hole 431 in the negative rotating direction (on the side closer to the starting point A). The intake hole 432 has the same shape as that of the intake hole 431 and passes through the pressure plate 41 in the z-axis direction. The main-body starting end portion 433, a portion between the intake holes 432 and 431, and the terminal end portion 436 of the intake-side arc-shaped groove 430 have a depth (in the z-axis direction) slightly smaller than 20% of the thickness of the pressure plate 41 (in the z-axis direction).

The notch 434 is formed so as to have a generally acute-angled triangular shape with a width in the rotor radial direction gradually increasing in the positive rotating direction as viewed in the z-axis direction. A maximum value of the width of the notch 434 in the rotor radial direction is set smaller than the width of the intake-side arc-shaped groove 430. A depth of the notch 434 (in the z-axis direction) gradually increases from 0 to several % of the thickness of the pressure plate 41 as the position in the notch 434 becomes closer to the main-body starting end portion 433 in the positive rotating direction. Specifically, the sectional area of a flow path of the notch 434 is smaller than that of a main body portion of the intake-side arc-shaped groove 430. The notch 434 forms a narrowed portion having a gradually increasing sectional area of the flow path in the positive rotating direction. A communication path 439 extending in parallel to the y-axis direction is formed in approximately the center of the intake-side arc-shaped groove 430 so as to be located slightly away from the y axis in the positive rotating direction. The communication path 439 is a groove that is open oriented toward the pressure plate 41 side, which is opposed to the cam ring 8. The communication path 439 is formed so as to communicate a low-pressure chamber R4 connected to a low-pressure chamber path 943 formed on the inner circumferential surface 95 of the adapter ring 9 to the intake port 43. The pressure plate 41 is formed of a sintered material by die molding. The communication path 439 is also formed by using a molding die for the pressure plate 41. In other words, the communication path 439 is formed by using the same molding die as that for the pressure plate 41. Therefore, a processing step for the communication path 439 can be omitted.

<Configuration of Delivery Port>

The delivery port 44 is a portion serving as an outlet for delivering the operating oil from the pump chambers r located on the delivery side to the exterior. The delivery port 44 is formed in a portion on the positive y-axis side, in which the volumes of the pump chambers r decrease in accordance with the rotation of the rotor 6. The delivery port 44 includes a delivery-side arc-shaped groove 440 and delivery holes 441 and 442. The delivery-side arc-shaped groove 440 is formed on the surface 410 of the pressure plate 41 and is a groove into which the hydraulic pressure on the pump delivery side is introduced. The delivery-side arc-shaped groove 440 is formed so as to have a generally arc-like shape about the rotation shaft O along the arrangement of the pump chambers r on the delivery side.

In an angular range corresponding to the delivery-side arc-shaped groove 440, specifically, a range of an angle formed between a starting point C of the delivery-side arc-shaped groove 440 located on the positive x-axis side with respect to the rotation axis O and an end point D located on the negative x-axis side with respect to the rotation axis O, a delivery region of the vane pump 1 is provided. The starting point C and the end point D of the delivery-side arc-shaped groove 440 is located away from the x-axis by a predetermined angle in the positive y-axis side.

A width of the delivery-side arc-shaped groove 440 in the rotor radial direction is set approximately equal over the entire range in the rotating direction and is slightly smaller than the width of the intake-side arc-shaped groove 430 in the rotor radial direction. An edge 446 of the delivery-side arc-shaped groove 440 on the rotor inner-diameter side (except for the projecting portions 62) is located slightly away from the outer circumferential surface 60 to the rotor outer-diameter side. An edge 447 of the delivery-side arc-shaped groove 440 on the rotor outer-diameter side approximately overlaps the inner circumferential surface 80 of the cam ring 8 located in the minimum eccentricity position. The pump chambers r located on the delivery side overlap the delivery-side arc-shaped groove 440 as viewed in the z-axis direction and are held in communication to the delivery-side arc-shaped groove 440 regardless of the eccentric position of the cam ring 8.

In a terminal end portion 444 of the delivery-side arc-shaped groove 440, which is located on the positive rotating direction side, the delivery hole 442 is formed. The delivery hole 442 has a generally elliptical shape as viewed in the z-axis direction. A width of the delivery hole 442 in the rotor radial direction is approximately equal to that of the delivery-side arc-shaped groove 440, and a length of the delivery hole 442 in the positive rotating direction is slightly longer than about one pitch. The delivery hole 442 is formed so as to pass through the pressure plate 41 in the z-axis direction. An edge of the delivery hole 442, which is located on the positive rotating direction side, is formed so as to have a generally semi-circular shape that is convex in the positive rotating direction, and coincides with an edge of the terminal end portion 444, which is located on the positive rotating direction side.

At a position in the delivery-side arc-shaped groove 440, which is closer to the negative rotating direction and is opposed to the intake hole 432 on the intake side through the rotation axis O therebetween, the delivery hole 441 is formed. The delivery hole 441 has the same shape as that of the delivery hole 442. The delivery hole 441 has a length of about one pitch in the positive rotating direction and is formed so as to pass through the pressure plate 41 in the z-axis direction. A starting end portion 443 of the delivery-side arc-shaped groove 440 is formed so as to extend from the starting point C to an edge 445 of the delivery hole 441, which is located on the side closer to the negative rotating direction. The edge 445 is formed so as to have a generally semi-circular shape that is convex in the negative rotating direction, as viewed in the z-axis direction. The end point D of the delivery-side arc-shaped groove 440 is located at the position about five pitches away from the starting point C in the positive rotating direction. A distal end of the starting end portion 443, which is opposed to the end point B of the intake-side arc-shaped groove 430 in the rotating direction, is formed so as to have a generally rectangular shape as viewed in the z-axis direction and has an edge extending in the rotor radial direction.

A depth of a main body portion 484 (in the z-axis direction) provided between the delivery holes 441 and 442 formed in the delivery-side arc-shaped groove 440 is about 25% of the thickness of the pressure plate 41 (in the z-axis direction). A groove depth is smaller in the starting end portion 443 than in the main body portion 484. An inclination is provided from the starting point C to the edge 445. The groove depth at the starting point C is about 0 and gradually increases toward the edge 445. The groove depth becomes slightly smaller than 10% of the thickness of the pressure plate 41 at the edge 445.

The starting end portion 443 is provided to have the following shape. Specifically, a sectional area of a flow path of the starting end portion 443 is smaller than that of the main body portion 484. A depth (in the z-axis direction) of the starting end portion 443 is formed so as to gradually increase in the positive rotating direction. Thus, the starting end portion 443 forms a narrowed portion having the sectional area of the flow path, which gradually increases in the positive rotating direction. No groove is formed on a portion of the surface 410, which is located between the end point B of the intake-side arc-shaped groove 430 and the starting point C of the delivery-side arc-shaped groove 440. In an angular range corresponding to the above-mentioned portion, specifically, in a range of an angle β formed between the end point B and the starting point C with respect to the rotation axis O, the first confinement region of the vane pump 1 is provided. The angular range of the first confinement region corresponds to about one pitch. Similarly, no groove is formed in a portion of the surface 410 between the end point D of the delivery-side arc-shaped groove 440 and the starting point A of the intake-side arc-shaped groove 430. In an angular range corresponding to the above-mentioned portion, specifically, in a range of the angle β formed between the end point D and the starting point A with respect to the rotation axis O, the second confinement region of the vane pump 1 is provided. The angular range of the second confinement region corresponds to about one pitch.

<Confinement Regions>

The first confinement region and the second confinement region are portions for confining the operating oil in the pump chambers r that are present in the first and second confinement regions so as to prevent the delivery-side arc-shaped groove 440 and the intake-side arc-shaped groove 430 from being brought into communication to each other. The first confinement region and the second confinement region are provided over the x axis (see FIG. 3).

<Back-Pressure Ports>

The back-pressure ports 45 and 46, which are held in communication to the bases of the vanes 7 (the back-pressure chambers br and the slot proximal end portions 610), are formed through the pressure plate 41 so as to be formed separately for the intake side and the delivery side (see FIG. 3).

<Intake-Side Back-Pressure Port> (See FIG. 3)

The intake-side back-pressure port 45 is a port for allowing communication between the back-pressure chambers br of the plurality of vanes 7, which are located in the intake region, most of the first confinement region, and a part of the second confinement region, and the delivery port 44. The vanes 7 "located in the intake region" means that the vane distal end portions 70 of the vanes 7 overlap the intake port 43 (intake-side arc-shaped groove 430), as viewed in the z-axis direction. The intake-side back-pressure port 45 includes an intake-side back-pressure arc-shaped groove 450 and communication holes 451*a* and 451*b*.

The intake-side back-pressure groove 450 is formed on the surface 410 of the pressure plate 41 and is a groove into which the hydraulic pressure on the pump delivery side is introduced. The intake-side back-pressure arc-shaped groove 450 is formed so as to have a generally arc-like shape about the rotation axis O along the arrangement of the back-pressure chambers br of the vanes 7 (the slot proximal end portions 610 of the rotor 6). The intake-side back-pressure arc-shaped groove 450 is formed over a larger range in the rotating direction than that of the intake-side arc-shaped groove 430.

A starting point a of the intake-side back-pressure arc-shaped groove 450 is located slightly away from the starting point A of the intake-side arc-shaped groove 430 (notch 434) in the negative rotating direction. An end point b of the intake-side back-pressure arc-shaped groove 450 is located away from the end portion B of the intake-side arc-shaped groove 430 in the positive rotating direction. A dimension of the intake-side back-pressure arc-shaped groove 450 in the rotor radial direction (groove width) is set approximately equal over the entire range in the rotating direction and is approximately equal to a dimension of each of the slot proximal end portions 610 in the rotor radial direction.

An edge 454 of the intake-side back-pressure arc-shaped groove 450 on the rotor inner-diameter side is located slightly away from the edges of the slot proximal end portions 610 on the rotor inner-diameter side to the rotor inner-diameter side. An edge 455 of the intake-side back-pressure arc-shaped groove 450 on the rotor outer-diameter side is located slightly away from the edges of the slot proximal end portions 610 on the rotor outer-diameter side to the rotor inner-diameter side. The intake-side back-pressure arc-shaped groove 450 is formed at a position in the rotor radial direction at which most of the intake-side back-pressure arc-shaped groove 450 overlaps the slot proximal end portions 610 (back-pressure chambers br) as viewed in the z-axis direction, regardless of the eccentric position of the cam ring 8. When the intake-side back-pressure arc-shaped groove 450 overlaps the slot proximal end portions 610 (back-pressure chambers br), the intake-side back-pressure arc-shaped groove 450 is brought into communication to the slot proximal end portions 610.

The communication hole 451*a* is formed in a portion of the intake-side back-pressure arc-shaped groove 450, which portion is located closer to the negative rotating direction side including the starting point a. The communication hole 451*a* has a generally elliptical shape as viewed in the z-axis direction and has a width in the rotor radial direction, which is approximately equal to that of the intake-side back-pressure arc-shaped groove 450. Similarly, the communication hole 451*b* is formed in a portion of the intake-side back-pressure arc-shaped groove 450, which portion is located closer the positive rotating direction side including the end point b. The communication holes 451*a* and 451*b* are formed so as to pass through the pressure plate 41 in the z-axis direction. The communication holes 451*a* and 451*b* are held in communication to the delivery holes 441 and 442 formed in the delivery-side arc-shaped groove 440 through a high-pressure chamber of the rear body 40.

<Delivery-Side Back-Pressure Port> (See FIG. 3)

The delivery-side back-pressure port 46 is a port for allowing communication between the back-pressure chambers br of the plurality of vanes 7, which are located in most of the delivery region, and the delivery port 44. The vanes 7 "located in the delivery region" means that the vane distal end portions 70 of the vanes 7 overlap the delivery port 44 (delivery-side arc-shaped groove 440), as viewed in the z-axis direction. The delivery-side back-pressure port 46 includes a delivery-side back-pressure arc-shaped groove 460 and a communication hole 461.

The delivery-side back-pressure arc-shaped groove 460 is formed on the surface 410 of the pressure plate 41 and is a groove to which the hydraulic pressure on the pump delivery side is introduced. The delivery-side back-pressure arc-shaped groove 460 is formed so as to have a generally arc-like shape about the rotation axis O along the arrangement of the back-pressure chambers br of the vanes 7 (slot proximal end portions 610). The delivery-side back-pressure arc-shaped groove 460 is formed over an angular range corresponding to about seven pitches (larger range than that of the delivery-side arc-shaped groove 440).

A starting point c of the delivery-side back-pressure arc-shaped groove 460 is located on the positive rotating direction side with respect to the starting point C of the delivery-side arc-shaped groove 440.

An end point d of the delivery-side back-pressure arc-shaped groove 460 is located on the negative rotation direction side with respect to the end point D of the delivery-side arc-shaped groove 440. A dimension (groove width) of the delivery-side back-pressure arc-shaped groove 460 in the rotor radial direction is set approximately equal over the entire range in the rotating direction, and is slightly smaller than that of the delivery-side arc-shaped groove 440 and is approximately equal to the dimension of the slot proximal end portions 610 in the rotor radial direction.

An edge 464 of the delivery-side back-pressure arc-shaped groove 460 on the rotor inner-diameter side is located slightly away from the edges of the slot proximal end portions 610 on the rotor inner-diameter side to the rotor outer-diameter side. An edge 465 of the delivery-side back-pressure arc-shaped groove 460 on the rotor outer-diameter side is located slightly away from the edges of the slot proximal end portions 610 on the rotor outer-diameter side to the rotor inner-diameter side. The delivery-side back-pressure arc-shaped groove 460 is formed at a position in the rotor radial direction at which most of the delivery-side back-pressure arc-shaped groove 460 overlaps the slot proximal end portions 610 (back-pressure chambers br) as viewed in the z-axis direction, regardless of the eccentric position of the cam ring 8. When the delivery-side back-pressure arc-shaped groove 460 overlaps the slot proximal end portions 610 (back-pressure chambers br), the delivery-side back-pressure arc-shaped groove 460 is brought into communication to the slot proximal end portions 610.

At a position at which the delivery-side back-pressure arc-shaped groove 460 intersects the y axis, the communication hole 461 is formed. A diameter of the communication hole 461 is approximately equal to the width of the delivery-side back-pressure arc-shaped groove 460 in the rotor radial direction. The communication hole 461 is formed so as to pass through the pressure plate 41 in the z-axis direction into a generally cylindrical shape. The communication hole 461 has an opening on the surface of the pressure plate 41 on the negative z-axis side and is held in communication to the delivery hole 441 of the delivery port 44 (delivery-side arc-shaped groove 440) through the high-pressure chamber of the rear body 40 described later.

<Details of Front Body>

Figure 4:
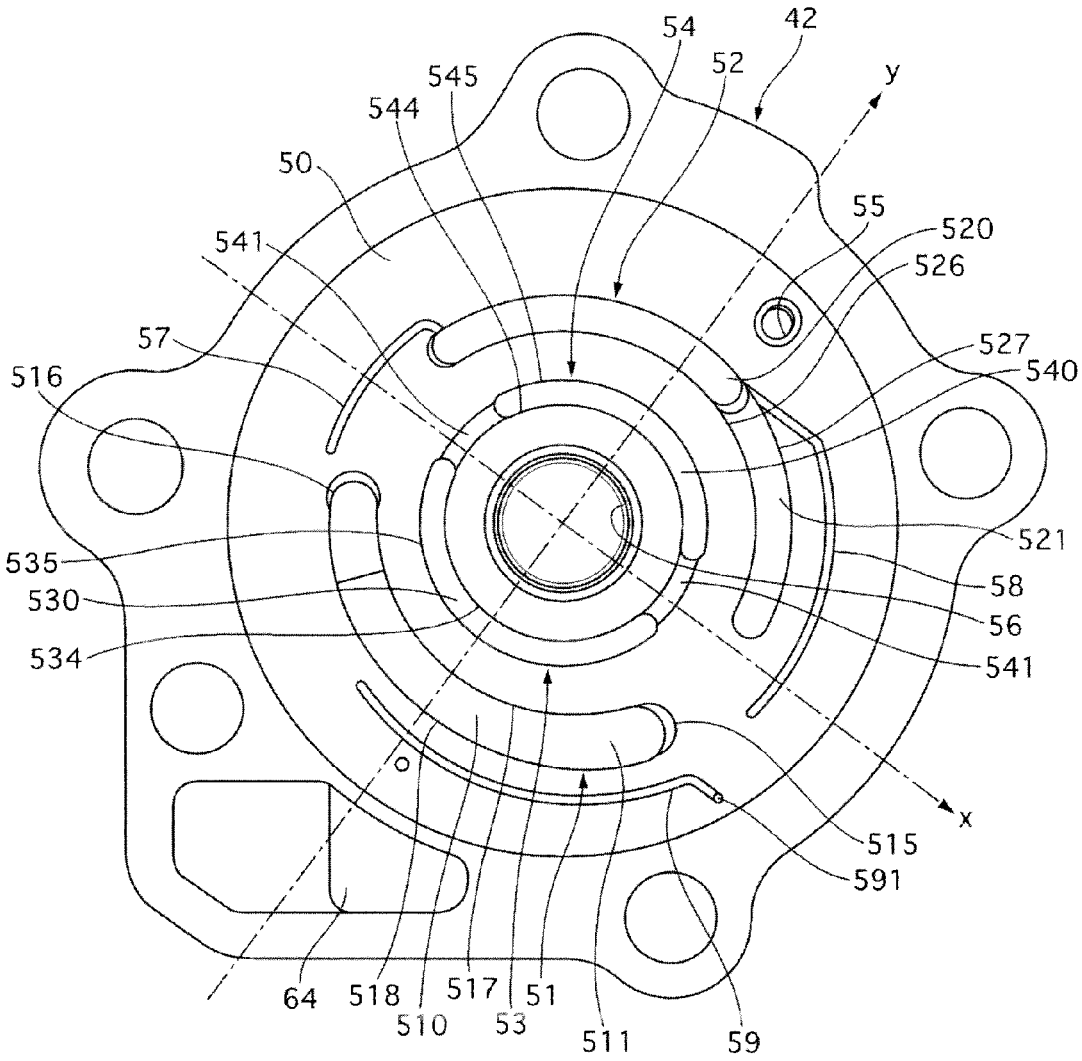
FIG. 4 is a view illustrating the front body according to the first embodiment, as viewed from the negative z-axis direction side.

FIG. 4 is a view illustrating the front body 42 as viewed from the negative z-axis direction side. The front body 42 includes a plate surface 50 projecting in the negative z-axis direction. An intake port 51, a delivery port 52, an intake-side back-pressure port 53, a delivery-side back-pressure port 54, a pin fixing hole 55, and a through hole 56 are formed through the plate surface 50. The pin 10 is inserted into the pin fixing hole 55 so as to be fixed therein. The driving shaft 5 is inserted into the through hole 56 so as to be provided rotatably. The intake port 51, the delivery port 52, the intake-side back-pressure port 53, and the delivery-side back-pressure port 54 are formed at positions respectively corresponding to the intake port 43, the delivery port 44, the intake-side back-pressure port 45, and the delivery-side back-pressure port 46 formed through the pressure plate 41.

<Configuration of Intake Port> (See FIG. 4)

The intake port 51 is held in communication to the pump chambers r on the intake side. The intake port 51 is formed in a portion on the negative y-axis side, in which the volumes of the pump chambers r increase in accordance with the rotation of the rotor 6. The intake port 51 includes an intake-side arc-shaped groove 510 and an intake hole 511. The intake-side arc-shaped groove 510 is formed so as to have a generally arc-like shape about the rotation axis O along the arrangement of the pump chambers r on the intake side.

A starting end portion 516 of the intake-side arc-shaped groove 510 is formed so as to have a generally semi-circular arc-like shape that is convex in the negative rotating direction. A terminal end portion 515 of the intake-side arc-shaped groove 510 is formed so as to have a generally semi-circular arc-like shape that is convex in the positive rotating direction. A width of the intake-side arc-shaped groove 510 in the rotor radial direction is set approximately equal over the entire range in the rotating direction and is approximately equal to the width of the annular chamber R3 in the rotor radial direction when the cam ring 8 is located in the minimum eccentricity position.

An edge 517 of the intake-side arc-shaped groove 510 on the rotor inner-diameter side is located slightly away from the outer circumferential surface 60 of the rotor 6 (except for the projecting portions 62) to the rotor outer-diameter side. An edge 518 of the intake-side arc-shaped groove 510 on the rotor outer-diameter side is located slightly away from the inner circumferential surface 80 of the cam ring 8 to the rotor outer-diameter side when the cam ring 8 is in the minimum eccentricity position, and on the terminal end side thereof, the edge 518 is located slightly away from the inner circumferential surface 80 of the cam ring 8 to the rotor outer-diameter side when the cam ring 8 is in the maximum eccentricity position. The pump chambers r located on the intake side overlap the intake-side arc-shaped groove 510 as viewed in the z-axis direction and are held in communication to the intake-side arc-shaped groove 510 regardless of the eccentric position of the cam ring 8.

The intake hole 511 is formed in the intake-side arc-shaped groove 510 so as to extend from the starting end portion to a point short of the terminal end portion (the intake hole 511 includes a semi-circle portion). A width of the intake hole 511 in the rotor radial direction is approximately equal to that of the intake-side arc-shaped groove 510. The intake hole 511 is connected to an intake path 64 formed in the front body 42. Through the intake path 64, the operating oil is supplied.

<Configuration of Delivery Port> (See FIG. 4)

The delivery port 52 is formed in a portion on the positive y-axis side, in which the volumes of the pump chambers r decrease in accordance with the rotation of the rotor 6. The delivery port 52 includes a delivery-side arc-shaped groove 520 having a notch 521. The delivery-side arc-shaped groove 520 is formed so as to have a generally arc-like shape about the rotation shaft O along the arrangement of the pump chambers r on the delivery side.

A width of the delivery-side arc-shaped groove 520 in the rotor radial direction is set approximately equal over its entire range in the rotating direction and is slightly smaller than that of the intake-side arc-shaped groove 510 in the rotor radial direction. An edge 526 of the delivery-side arc-shaped groove 520 on the rotor inner-diameter side is located slightly away from the outer circumferential surface 60 of the rotor 6 (except for the projecting portions 62) to the rotor outer-diameter side. An edge 527 of the delivery-side arc-shaped groove 520 on the rotor outer-diameter side approximately overlaps the inner circumferential surface 80 of the cam ring 8 when the cam ring 8 is in the minimum eccentricity position. The pump chambers r located on the delivery side overlap the delivery-side arc-shaped groove 520 as viewed in the z-axis direction and are held in communication to the delivery-side arc-shaped groove 520 regardless of the eccentric position of the cam ring 8.

The notch 521 is formed in an end portion of the delivery-side arc-shaped groove 520, which is located closer to the negative rotating direction side. The notch 521 is formed so as to have a smaller depth than that of the delivery-side arc-shaped groove 520.

An end portion of the delivery-side arc-shaped groove 520, which is closer to the positive rotating direction side, is formed so as to have a generally semi-circular shape that is convex in the positive rotating direction. The boundary portion between the delivery-side arc-shaped groove 520 and the notch 521, which is closer to the negative rotating direction side, is formed so as to have a generally semi-circular shape that is convex in the negative rotating direction.

<Configuration of Intake-Side Back-Pressure Port> (See FIG. 4)

The intake-side back-pressure port 53 and the delivery-side back-pressure port 54, which are held in communication to the bases of the vanes 7 (the back-pressure chambers br and the slot proximal end portions 610), are formed through the plate surface 50 separately on the intake side and the delivery side. The intake-side back-pressure port 53 is a port for allowing communication between the back-pressure chambers br of the plurality of vanes 7 located in most of the intake region and the delivery port 52. The intake-side back-pressure port 53 includes an intake-side back-pressure arc-shaped groove 530.

The intake-side back-pressure arc-shaped groove 530 is formed so as to have a generally arc-like shape about the rotation axis O along the arrangement of the back-pressure chambers br of the vanes 7 (the slot proximal end portions 610 of the rotor 6). The intake-side back-pressure arc-shaped groove 530 is formed over a larger range in the rotating direction than that of the intake-side arc-shaped groove 510.

A dimension of the intake-side back-pressure arc-shaped groove 530 in the rotor radial direction (groove width) is set approximately equal over the entire range in the rotating direction and is approximately equal to that of the intake-side arc-shaped groove 510 and the dimension of each of the slot proximal end portions 610 in the rotor radial direction.

An edge 534 of the intake-side back-pressure arc-shaped groove 530 on the rotor inner-diameter side is located slightly away from the edges of the slot proximal end portions 610 on the rotor inner-diameter side to the rotor inner-diameter side. An edge 535 of the intake-side back-pressure arc-shaped groove 530 on the rotor outer-diameter side is located slightly away from the edges of the slot proximal end portions 610 on the rotor outer-diameter side to the rotor inner-diameter side. The intake-side back-pressure arc-shaped groove 530 is formed at a position in the rotor radial direction at which most of the intake-side back-pressure arc-shaped groove 530 overlaps the slot proximal end portions 610 (back-pressure chambers br) as viewed in the z-axis direction, regardless of the eccentric position of the cam ring 8. When the intake-side back-pressure arc-shaped groove 530 overlaps the slot proximal end portions 610 (back-pressure chambers br), the intake-side back-pressure arc-shaped groove 530 is brought into communication to the slot proximal end portions 610. Orifice grooves 541 are formed at a starting end and a terminal end of the intake-side back-pressure arc-shaped groove 530 so as to be connected to a starting end and a terminal end of a delivery-side back-pressure arc-shaped groove 540 described later.

<Configuration of Delivery-Side Back-Pressure Port> (See FIG. 4)

The delivery-side back-pressure port 54 includes the delivery-side back-pressure arc-shaped groove 540. The delivery-side back-pressure arc-shaped groove 540 is formed so as to have a generally arc-like shape about the rotation axis O along the arrangement of the back-pressure chambers br of the vanes 7 (slot proximal end portions 610). The delivery-side back-pressure arc-shaped groove 540 is formed in a range smaller than that of a combination of the delivery-side arc-shaped groove 520 and the notch 521 in the rotating direction. A dimension (groove width) of the delivery-side back-pressure arc-shaped groove 540 in the rotor radial direction is set approximately equal over its entire range in the rotating direction, and is slightly smaller than that of the delivery-side arc-shaped groove 520 and slightly smaller than the dimension of each of the slot proximal end portions 610 in the rotor radial direction.

An edge 544 of the delivery-side back-pressure arc-shaped groove 540 on the rotor inner-diameter side is located slightly away from the edges of the slot proximal end portions 610 on the rotor inner-diameter side to the rotor outer-diameter side. An edge 545 of the delivery-side back-pressure arc-shaped groove 540 on the rotor outer-diameter side is located slightly away from the edges of the slot proximal end portions 610 on the rotor outer-diameter side to the rotor inner-diameter side. The delivery-side back-pressure arc-shaped groove 540 is formed at a position in the rotor radial direction at which most of the delivery-side back-pressure arc-shaped groove 540 overlaps the slot proximal end portions 610 (back-pressure chambers br) as viewed in the z-axis direction, regardless of the eccentric position of the cam ring 8. When the delivery-side back-pressure arc-shaped groove 540 overlaps the slot proximal end portions 610 (back-pressure chambers br), the delivery-side back-pressure arc-shaped groove 540 is brought into communication to the slot proximal end portions 610.

End portions of the delivery-side back-pressure arc-shaped groove 540, which are respectively closer to the positive rotating direction side and the negative rotating direction side, are formed so as to have generally semi-circular shapes that are convex in the positive rotating direction and the negative rotating direction, respectively.

<Lubricating-Oil Grooves> (See FIG. 4)

A lubricating-oil groove 57 held in communication to a portion in the second confinement region, which portion is on the outer circumferential side with respect to the intake port 51 and the delivery port 52, is formed at an end of the delivery-side arc-shaped groove 520 of the delivery port 52 closer to the negative rotating direction side. Further, a lubricating-oil groove 58 held in communication to a portion in the first confinement region, which portion is on the outer circumferential side with respect to the intake port 51 and the delivery port 52, is formed at a portion of the delivery-side arc-shaped groove 52 closer to the positive rotating direction. Through the lubricating-oil grooves 57 and 58, the operating oil is supplied as lubricating oil to a portion between the swinging cam ring 8 and the plate surface 50.

On the outer circumferential side of the intake port 51, a lubricating-oil groove 59 is formed. Through the lubricating-oil groove 59, the operating oil in the first control-pressure chamber R1 is supplied as lubricating oil from a lubricating-oil intake hole 591 to the portion between the swinging cam ring 8 and the plate surface 50.

<Details of Control Section>

Figure 5:
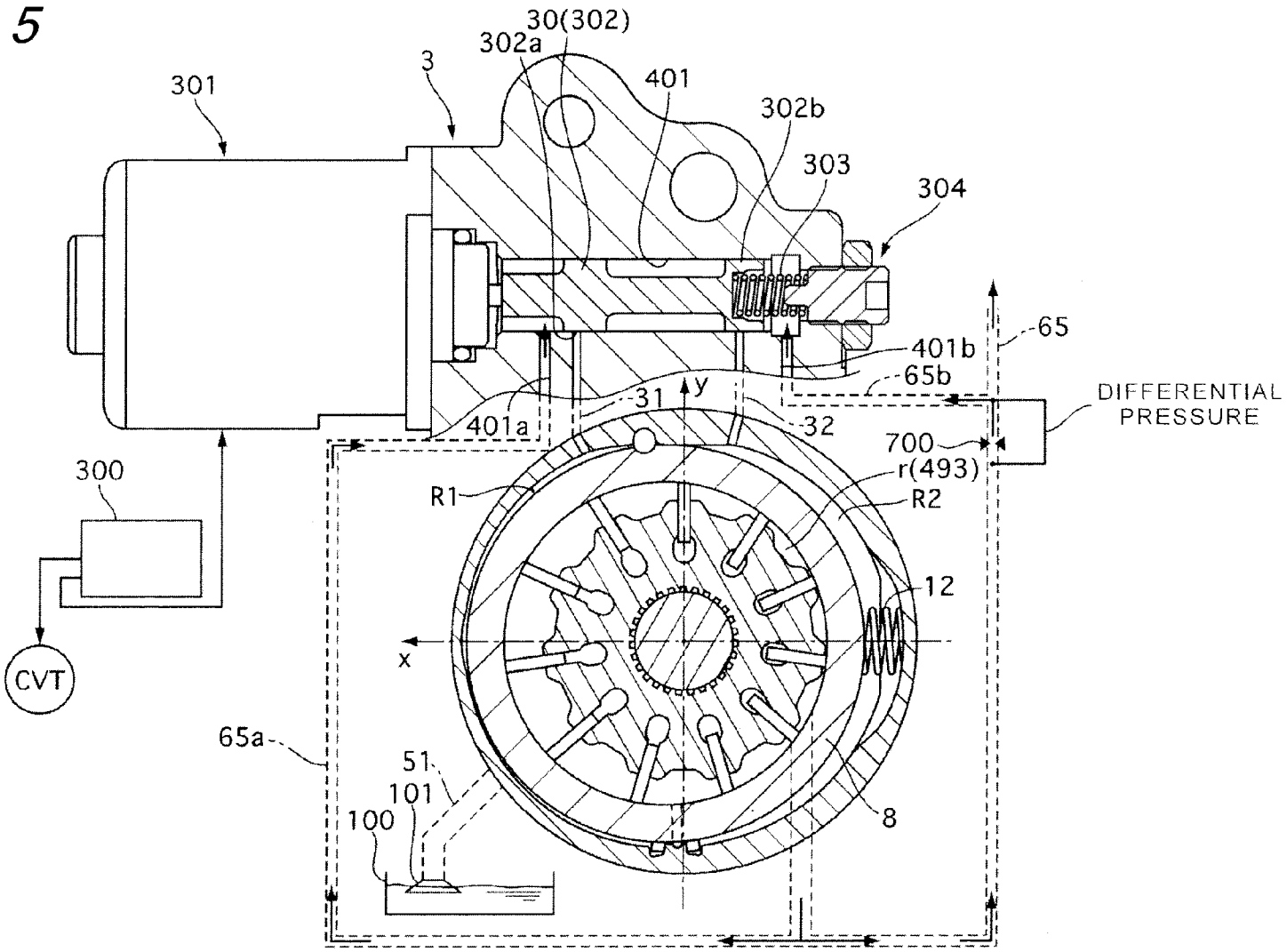
FIG. 5 is a schematic view illustrating a relationship between a control section and control-pressure chambers according to the first embodiment.

Returning to FIG. 1, the control section 3 is provided to the rear body 40. The control section 3 includes a control valve 30, a first passage 31, a second passage 32, and the control-pressure chambers R1 and R2. The control valve 30 is a spool valve for controlling inflow and outflow of the hydraulic fluid into/from the first control-pressure chamber R1 and the second control-pressure chamber R2. The control valve 30 includes a spool 302, a spring 303, an adjustment mechanism 304, and a solenoid 301 with a plunger 301*a*. The spool 302 is housed in a housing hole 401 of the rear body 40. The spring 303 biases the spool 302 toward the solenoid 301. The adjustment mechanism 304 adjusts a retaining position (set spring load) for the spring 303. The plunger 301*a* applies a biasing force for the spool 302 in a direction opposite to a load direction of the spring 303, as requested. In an end portion of the housing hole 401 on the positive x-axis side, an upstream-side port 401*a* to which a delivery pressure on the upstream side of a metering orifice 700 described later is supplied. The first passage 31 is formed so as to be adjacent to the upstream-side port 401*a* in the negative x-axis direction. A first land portion 302*a* of the spool 302 is provided so as to allow communication between the upstream-side port 401*a* and the first passage 31 or interrupt the communication therebetween. On the other hand, in an end portion of the housing hole 401 on the negative x-axis side, a downstream-side port 401*b* to which a delivery pressure on the downstream side of the metering orifice 700 described later is supplied is formed. The second passage 32 is formed so as to be adjacent to the downstream-side port 401*b* in the positive x-axis direction. A second land portion 302*b* of the spool 302 is provided so as to allow communication between the downstream-side port 401*b* and the second passage 32 or interrupt the communication therebetween. FIG. 5 is a schematic view illustrating a relationship between the control section and the control-pressure chambers according to the first embodiment. On a passage connecting a delivery chamber 493 for the pump chambers r and a delivery passage 65, an upstream-side oil path 65*a* and a downstream-side oil path 65*b* are provided. The upstream-side oil path 65*a* branches on the upstream side of the metering orifice 700 and is connected to the upstream-side port 401*a*. The downstream-side oil path 65*b* branches on the downstream side of the metering orifice 700 and is connected to the downstream-side port 401*b*. Through the intake port 51 of the variable displacement vane pump, the operating oil, which is taken in through a strainer 101 immersed into the operating oil contained in an oil pan 100 through a filter for removing an impurity such as contamination or the like, is supplied to the pump so as to supply the delivery pressure to various types of hydraulic-pressure control units. The oil pan 100 is provided in a lower part of a transmission unit in which the CVT is mounted.

<Functions>

Functions of the vane pump 1 according to the first embodiment are described (see FIG. 2).

<Pump Functions>

By rotating the rotor 6 in a state in which the cam ring 8 is located eccentrically in the positive x-axis direction with respect to the rotation axis O, the pump chambers r periodically expand and contract while rotating about the rotation axis O. On the negative y-axis side, on which the pump chambers r become larger in the positive rotating direction, the operating oil is taken in through the intake port 43 into the pump chambers r. On the positive y-axis side, on which the pump chambers r become smaller in the positive rotating direction, the taken in operating oil is delivered from the pump chambers r to the delivery port 44.

Specifically, the description is now given focusing on one of the pump chambers r. In the intake region, until one of the vanes 7 of the pump chamber r on the negative side in the rotating direction (hereinafter referred to as "rear-side vane 7") passes through the end point B of the intake-side arc-shaped groove 430, in other words, until the other of the vanes 7 on the positive side in the rotating direction (hereinafter referred to as "front-side vane 7") passes through the starting point C of the delivery-side arc-shaped groove 440, the volume of the pump chamber r increases. Meanwhile, the pump chamber r is held in communication to the intake-side arc-shaped groove 430. Therefore, the operating oil is taken in through the intake port 43. At a rotational position at which the rear-side vane 7 (surface thereof oriented in the positive rotating direction) of the pump chamber r coincides with the end point B of the intake-side arc-shaped groove 430 and the front-side vane 7 (surface thereof oriented in the negative rotating direction) coincides with the starting point C of the delivery-side arc-shaped groove 440 in the first confinement region, the pump chamber r is brought into communication neither to the intake-side arc-shaped groove 430 nor to the delivery-side arc-shaped groove 440 and is held in a fluid-tight state.

After the rear-side vane 7 of the pump chamber r passes through the end point B of the intake-side arc-shaped groove 430 (after the front-side vane 7 passes through the starting point C of the delivery-side arc-shaped groove 440), the volume of the pump chamber r decreases in the delivery region in accordance with the rotation and the pump chamber r is brought into communication to the delivery-side arc-shaped groove 440. Therefore, the operating oil is delivered from the pump chamber r to the delivery port 44.

At a position at which the rear-side vane 7 of the pump chamber r (surface thereof oriented in the positive rotating direction) coincides with the end point D of the delivery-side arc-shaped groove 440 and the front-side vane 7 (surface thereof oriented in the negative rotating direction) coincides with the starting point A of the intake-side arc-shaped groove 430 in the second confinement region, the pump chamber r is brought into communication neither to the delivery-side arc-shaped groove 440 nor to the intake-side arc-shaped groove 430 and is held in a fluid-tight state.

In the first embodiment, the range of each of the first confinement region and the second confinement region corresponds to one pitch (corresponding to one pump chamber r). Therefore, while the intake region and the delivery region are prevented from being brought into communication to each other, pump efficiency can be improved. Each of the first and second confinement regions (distance between the intake port 43 and the delivery port 44) may be provided over a range larger than one pitch. In other words, the angular range of each of the confinement regions can be set arbitrarily as long as the delivery region and the intake region are not brought into communication to each other.

When the front-side vane 7 (surface thereof oriented in the negative rotating direction) moves from the first confinement region to the delivery region, the pump chamber r and the delivery-side arc-shaped groove 440 are not suddenly brought into communication to each other due to the narrowing function of the starting end portion 443. Therefore, the pressures at the delivery port 44 and in the pump chamber r are prevented from fluctuating. Specifically, the operating oil is prevented from suddenly flowing from the delivery port 44 at a high pressure to the pump chamber r at a low pressure. Thus, a flow rate of the operating oil to be supplied from the delivery port 44 to an external pipe connected through the delivery hole 442 is prevented from suddenly decreasing. Thus, the pressure fluctuation (oil hammer) in the pipe can be suppressed. Further, the flow rate of the operating oil to be supplied to the pump chamber r can be prevented from suddenly increasing. Therefore, the pressure fluctuation in the pump chamber r can also be suppressed. The starting end portion 443 may be omitted as needed.

When the front-side vane 7 (surface thereof oriented in the negative rotating direction) moves from the second confinement region to the intake region, the pump chamber r and the intake-side arc-shaped groove 430 are not suddenly brought into communication to each other due to the narrowing function of the notch 434. Therefore, the pressures at the intake port 43 and in the pump chamber r are prevented from fluctuating. Specifically, the volume of the pump chamber r is prevented from increasing at a time. Thus, the operating oil is prevented from suddenly flowing out from the pump chamber r at the high pressure into the intake port 43 at the low pressure. Further, the notch 434 may be omitted as needed.

<Capacity Varying Functions>

A state in which the solenoid 301 is unactuated is first described. An initially set load is applied to the spool 302 by the spring 303 in the positive x-axis direction. In an early stage of actuation of the pump, in which the flow rate is relatively low, a differential pressure between a pressure before the passage through the metering orifice 700 and a pressure after the passage therethrough is not so large. The spool 302 is biased in the positive x-axis direction by a load of the spring 303. Thus, the first land portion 302*a* interrupts the communication between the upstream-side port 401*a* and the first passage 31, whereas the second land portion 302*b* allows communication between the downstream-side port 401*b* and the second passage 32. As a result, the delivery pressure is not supplied to the first control-pressure chamber R1, whereas the delivery pressure is supplied to the second control-pressure chamber R2. Therefore, the cam ring 8 is placed in an eccentric state so as to increase a pump delivery flow rate in accordance with an rpm. When the pump delivery flow rate increases, the differential pressure between the pressure on the upstream side and the pressure on the downstream side of the metering orifice 700 becomes larger. At this time, a large force acting in the negative x-axis direction is exerted on the first land portion 302*a* of the spool 302 so as to start exerting a force larger than the initially set load of the spring 303. Then, the first land portion 302*a* allows communication between the upstream-side port 401*a* and the first passage 31, whereas the second land portion 302*b* interrupts the communication between the downstream-side port 401*b* and the second passage 32. As a result, the high delivery pressure on the upstream side of the metering orifice 700 is supplied to the first control-pressure chamber R1, whereas the supply of the delivery pressure to the second control-pressure chamber R2 is stopped. As a result, the eccentricity of the cam ring 8 becomes smaller. Thus, even when the rpm of the pump increases, the pump delivery flow rate does not increase. If the pump delivery flow rate becomes too small, the differential pressure between the pressure on the upstream side and the pressure on the downstream side of the metering orifice 700 becomes smaller. Thus, the cam ring 8 is located eccentrically again so as to appropriately increase the delivery flow rate again.

When the solenoid 301 is in the unactuated state, the hydraulic pressure is the only force against the initially set load of the spring 303. Thus, if the delivery flow rate does not become large, a sufficiently large differential pressure between the pressure on the upstream side and the pressure on the downstream side of the metering orifice 700 cannot be ensured. Therefore, after a relatively high delivery flow rate is achieved, a constant flow rate is maintained. Next, when the solenoid 301 is energized so as to generate a predetermined biasing force, the same effects as those obtained when the initially set load of the spring 303 is changed smaller are obtained. Thus, at earlier timing than that in the case where the solenoid 301 is unactuated, the state of the spool 32 is switched. Even if the differential pressure between the pressure on the upstream side and the pressure on the downstream side of the metering orifice 700 is not large, the spool 302 is actuated under a slightly small differential pressure. After a relatively low delivery flow rate is achieved, a constant flow rate is maintained. Specifically, the delivery flow rate can be controlled by the biasing force to be generated by the solenoid 301. A CVT control unit 300 appropriately controls a line pressure of the CVT in accordance with running conditions including an accelerator opening degree, an engine rpm, and a vehicle speed. Therefore, when the high delivery flow rate is requested, a current (electromagnetic force) to flow through the solenoid 301 is turned OFF or is reduced. On the other hand, when the low delivery flow rate is requested, the current (electromagnetic force) to flow through the solenoid 301 is increased.

<Configuration of Sealed Portion>

Next, a problem relating to the pair of sealing members 11 (11*a* and 11*b*) provided to the fourth plane portion 94 is described. In the variable displacement vane pump, a proper delivery amount can be varied by controlling the eccentricity of the cam ring 8. By changing the delivery flow rate as needed, an unnecessary pump driving torque can be reduced, which contributes to an improvement of fuel efficiency. The eccentricity of the cam ring 8 is controlled by controlling the pressures in the first control-pressure chamber R1 and the second control-pressure chamber R2. Thus, it is necessary that the first control-pressure chamber R1 and the second control-pressure chamber R2 are formed separately in the partitioned manner. Hitherto, the first control-pressure chamber R1 and the second control-pressure chamber R2 are formed separately in the partitioned manner by providing a single sealing member so as to be received in a concave portion formed on the inner circumferential surface 95 of the adapter ring 9 and pressing the sealing member against the outer circumferential surface 81 of the cam ring 8 so as to bring the sealing member into sliding contact therewith. In this structure, however, in a case where a magnitude relationship between the pressure in the first control-pressure chamber R1 and that in the second control-pressure chamber R2 frequently changes, there is a fear in that the sealing member moves horizontally to lower durability of an edge portion of the sealing member. Further, when the volume of the first control-pressure chamber R1 or the second control-pressure chamber R2 varies due to the swing of the cam ring 8, the pressure is further fluctuated. Therefore, the phenomenon of the horizontal movement of the sealing member becomes further noticeable. Further, if a leakage occurs from a sealed portion in a state in which an absolute pressure in the first control-pressure chamber R1 or the second control-pressure chamber R2 is high, cavitation erosion occurs due to air contained in operating oil. In order to avoid the occurrence of cavitation erosion, it is conceivable to select a material having a high hardness and a high strength as a material of the sealing member. If such a material is used, however, when the sealing member moves due to a fluctuation in differential pressure between the first control-pressure chamber R1 and the second control-pressure chamber R2, there is a fear in that the adapter ring 9, to which the sealing member is provided, may be struck to lower durability of the adapter ring 9. Thus, in order to provide a sealing structure in which the sealing member does not move regardless of a state of the control pressures in the first control-pressure chamber R1 and the second control-pressure chamber R2, the following configuration is adopted.

Figure 6:
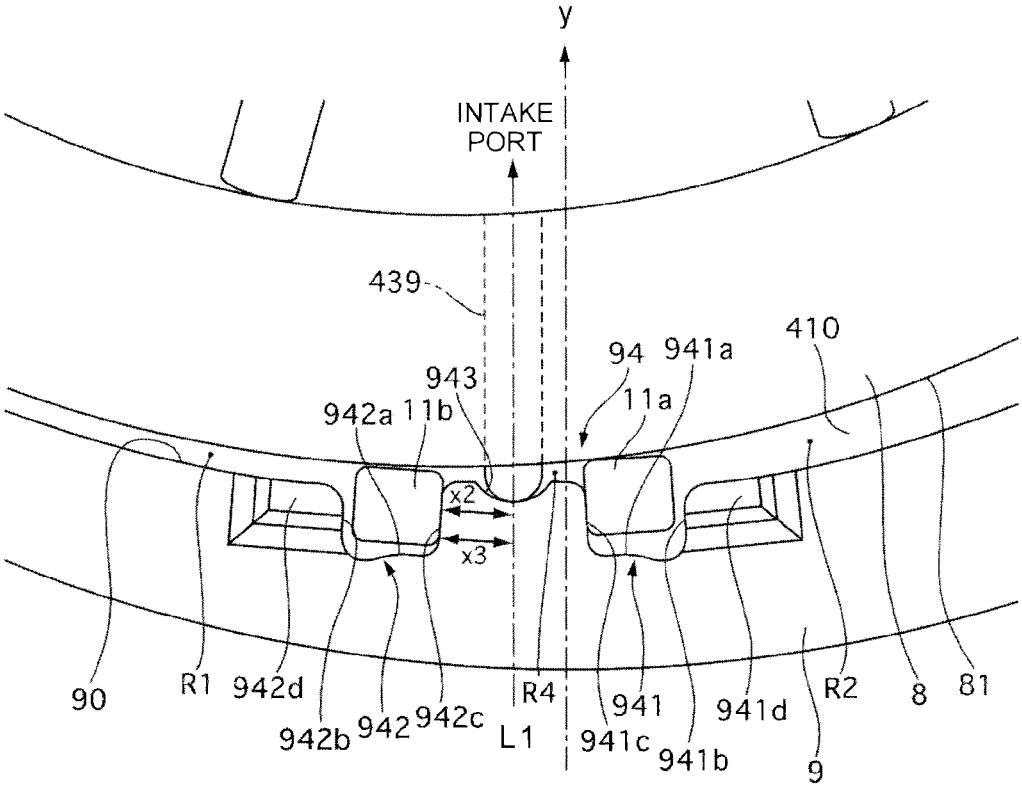
FIG. 6 is an enlarged view of a fourth plane portion according to the first embodiment.

FIG. 6 is an enlarged view of the fourth plane portion 94 according to the first embodiment. The first sealing groove 941 is formed on the fourth plane portion 94 of the adapter ring 9 so as to be located on the right of the y axis in FIG. 6 and be concave in the y-axis direction. The first sealing groove 941 includes a bottom portion 941*a*, a first low-pressure chamber side wall portion 941*c*, and a first high-pressure chamber side wall portion 941*b*. The bottom portion 941*a* is located on the outermost diameter side in the radial direction. The first low-pressure chamber side wall portion 941*c* rising from the bottom portion 941*a* in the positive y-axis direction is provided on the low-pressure chamber R4 side. The first high-pressure chamber side wall portion 941*b* rising from the bottom portion 941*a* in the positive y-axis direction is provided on the second control-pressure chamber R2 side. A first pressure introduction path 941*d* cut in the z-axis direction is formed through the first high-pressure chamber side wall portion 941*b* so that a control pressure in the second control-pressure chamber R2 can be introduced into the first sealing groove 941. In the first sealing groove 941, the first sealing member 11*a* is provided. The first sealing member 11*a* is formed of a fiber reinforced resin material by die molding. The first sealing member 11*a* is formed so as to have a cuboidal shape with a generally rectangular sectional shape and approximately the same length as a thickness of the cam ring 8 and that of the adapter ring 9 in the z-axis direction. A circumferential length of the first sealing member 11*a* is set so as to be smaller than a circumferential length of the bottom portion 941*a* of the first sealing groove 941. In a state in which the first sealing member 11*a* is held in contact with the first low-pressure chamber side wall portion 941*c*, a gap is formed between the first sealing member 11*a* and the first high-pressure chamber side wall portion 941*b*. Further, a virtual line L1 in the radial direction is set in a middle point of the low-pressure chamber R4 in the circumferential direction. The first low-pressure chamber side wall portion 941*c* is formed so that a distance between the wall surface of the first low-pressure chamber side wall portion 941*c* and the virtual line L1 becomes smaller as a position at which the above-mentioned distance is measured becomes closer to the driving shaft 5. Specifically, a length x2 between the wall surface of the first low-pressure chamber side wall portion 941*c* and the virtual line L1 on the radially inner side in FIG. 6 is formed so as to be shorter than a length x3 on the radially outer side. As a result, when the first sealing member 11*a* is pressed against the outer circumferential surface 81 of the cam ring 8, a contact surface of the first sealing member 11*a* lies along a tangential direction of the cam ring 8, thereby improving sealability.

Similarly, the second sealing groove 942 is formed on the fourth plane portion 94 of the adapter ring 9 so as to be located on the left of the y axis in FIG. 6 and be concave in the y-axis direction. The second sealing groove 942 includes a bottom portion 942*a*, a second low-pressure chamber side wall portion 942*c*, and a second high-pressure chamber side wall portion 942*b*. The bottom portion 942*a* is located on the outermost diameter side in the radial direction. The second low-pressure chamber side wall portion 942*c* rising from the bottom portion 942*a* in the negative y-axis direction is provided on the low-pressure chamber R4 side. The second high-pressure chamber side wall portion 942*b* rising from the bottom portion 942*a* in the negative y-axis direction is provided on the first control-pressure chamber R1 side. A second pressure introduction path 942*d* cut in the z-axis direction is formed through the second high-pressure chamber side wall portion 942*b* so that a control pressure in the first control-pressure chamber R1 can be introduced into the second sealing groove 942. In the second sealing groove 942, the second sealing member 11*b* is provided. The second sealing member 11*b* is formed of a fiber reinforced resin material by die molding. The second sealing member 11*b* is formed so as to have a cuboidal shape with a generally rectangular sectional shape and approximately the same length as the thickness of the cam ring 8 and that of the adapter ring 9 in the z-axis direction. A circumferential length of the second sealing member 11*b* is set so as to be smaller than a circumferential length of the bottom portion 942*a* of the second sealing groove 942. In a state in which the second sealing member 11*b* is held in contact with the second low-pressure chamber side wall portion 942*c*, a gap is formed between the second sealing member 11*b* and the second high-pressure chamber side wall portion 942*b*. Similarly to the case of the wall surface of the first low-pressure chamber side wall portion 941*c*, the virtual line L1, which connects the middle point of the low-pressure chamber R4 in the circumferential direction and the rotation axis of the driving shaft 5, is set. The second low-pressure chamber side wall portion 942*c* is formed so that a distance between the wall surface of the second low-pressure chamber side wall portion 942*c* and the virtual line L1 becomes smaller as a position at which the above-mentioned distance is measured becomes closer to the driving shaft 5. As a result, when the second sealing member 11*b* is pressed against the outer circumferential surface 81 of the cam ring 8, a contact surface of the second sealing member 11*b* lies along the tangential direction of the cam ring 8, thereby improving the sealability.

At a position between the first sealing groove 941 and the second sealing groove 942 on the fourth plane portion 94 of the adapter ring 9, a low-pressure chamber path 943 is formed so as to be concave in the y-axis direction with a depth smaller than those of the sealing grooves 941 and 942. The low-pressure chamber path 943 is formed at a position slightly away from the y axis in the positive rotating direction. The communication path 439 extending in parallel to the y-axis direction is formed in approximately the center of the intake-side arc-shaped groove 430 on the surface 410 of the pressure plate 41 so as to be slightly away from the y axis in the positive rotating direction. The communication path 439 is formed so as to allow the communication between the low-pressure chamber path 943 formed on the inner circumferential surface 95 of the adapter ring 9 and the intake port 43.

As illustrated in FIG. 6, the low-pressure chamber R4 is formed in a region defined by the first sealing member 11*a*, the second sealing member 11*b*, a portion of the inner circumferential surface 95, which is located between the first sealing groove 941 and the second sealing groove 942, and the outer circumferential surface 81 of the cam ring 8. The low-pressure chamber R4 is constantly connected to the intake port 43. A pressure in the low-pressure chamber R4 is always lower than those in the first control-pressure chamber R1 and the second control-pressure chamber R2 regardless of control states of the first control-pressure chamber R1 and the second control-pressure chamber R2. Thus, the first sealing member 11*a* and the second sealing member 11*b* are pressed against the outer circumferential surface 81 of the cam ring 8 by control pressures introduced into the sealing grooves 941 and 942 through the first pressure introduction path 941*d* and the second pressure introduction path 942*d*, and are also pressed against the first low-pressure chamber side wall portion 941*c* and the second low-pressure chamber side wall portion 942*c*. Even if a pressure fluctuation occurs in the first control-pressure chamber R1 or the second control-pressure chamber R2, the first sealing member 11*a* and the second sealing member 11*b* are prevented from moving horizontally in FIG. 6.

Further, a virtual line connecting the center axis on the inner circumferential surface of the cam ring 8 and the middle point of the low-pressure chamber R4 in the circumferential direction and moving along with the movement of the cam ring 8 is assumed as a cam-ring virtual center line L3. Then, a first intersection P1 is an intersection between a virtual line L22 extending along the wall surface of the first low-pressure chamber side wall portion 941*c* toward the driving shaft 5 and a virtual line L21 extending along the wall surface of the second low-pressure chamber side wall portion 942*c* toward the driving shaft 5. The first sealing groove 941 and the second sealing groove 942 are formed so that the cam ring 8 is located between the maximum eccentricity position and the minimum eccentricity position when the cam-ring virtual center line L3 passes through the first intersection P1. In other words, the first low-pressure chamber side wall portion 941*c* and the second low-pressure chamber side wall portion 942*c* are formed so that the first intersection P1 is present in a region dx through which the cam-ring virtual center line L3 passes. In this manner, when the first sealing member 11*a* and the second sealing member 11*b* come into contact with the outer circumferential surface 81 of the cam ring 8, the cam ring 8 moves within a range including a position at which a contact angle between each of the first sealing member 11*a* and the second sealing member 11*b* and the outer circumferential surface 81 becomes the smallest. A maximum value of the relative angle at a portion at which each of the sealing members 11*a* and 11*b* and the cam ring 8 comes into contact with can be reduced when the cam ring 8 is located in the maximum eccentricity position or the minimum eccentricity position. As a result, partial contact of each of the sealing members 11*a* and 11*b* is suppressed.

<Effects>

Now, effects of the vane pump 1, which are understood in the first embodiment, are listed.

(1-(1)) The variable displacement vane pump includes: the pump housing including a pump-element housing portion; the driving shaft 5 rotatably supported by the pump housing; the rotor 6 provided inside the pump housing so as to be rotationally driven by the driving shaft 5, the rotor 6 including the plurality of slots 61 arranged in the circumferential direction, which is the direction about the rotation axis of the driving shaft 5; the plurality of vanes 7 provided in the plurality of slots 61 so as to be projectable therefrom and retractable therein; the cam ring 8 formed so as to have an annular shape, the cam ring 8 being provided so as to be movable inside the pump-element housing portion, the cam ring 8 forming the plurality of pump chambers on the inner circumferential side in cooperation with the rotor 6 and the plurality of vanes 7; the intake port 43 formed in the pump housing, the intake port 43 having the opening in the intake region, in which the volumes of the plurality of pump chambers r increase along with the rotation of the rotor 6; the delivery port 44 having the opening in the delivery region, in which the volumes of the plurality of pump chambers r decrease along with the rotation of the rotor 6; the pair of sealing grooves formed on the pump-element housing portion so as to have the openings oriented toward the outer circumferential surface of the cam ring 8 in the radial direction, which is the radiation direction of the rotation axis of the driving shaft 5, the pair of sealing grooves being the first sealing groove 941 and the second sealing groove 942 formed on the intake port 43 side with respect to the driving shaft 5 so as to be separated away from each other in the circumferential direction; the pair of sealing members which are the first sealing member 11*a* provided in the first sealing groove 941 and the second sealing member 11*b* provided in the second sealing groove 942; the pair of pressure chambers formed between the pump-element housing portion and the cam ring 8 in the radial direction so as to be separated by the first sealing member 11*a* and the second sealing member 11*b*, the pair of pressure chambers being: (i) the first fluid-pressure chamber R1 provided on the side on which the volume thereof decreases when the cam ring 8 moves to the side on which the eccentricity of the cam ring 8 increases, the first fluid-pressure chamber R1 being configured such that the delivery pressure delivered through the delivery port 44 is introduced so that the pressure in the first fluid-pressure chamber R1 becomes higher than the pressure in the low-pressure chamber R4, which is the pressure chamber formed between the first sealing member 11*a* and the second sealing member 11*b*; and (ii) the second fluid-pressure chamber R2 provided on the side on which the volume thereof increases when the cam ring 8 moves to the side on which the eccentricity of the cam ring 8 increases, the second fluid-pressure chamber R2 being configured such that the delivery pressure delivered through the delivery port 44 is introduced so that the pressure in the second fluid-pressure chamber R2 becomes higher than the pressure in the low-pressure chamber R4; and the control valve 30 configured to control the pressure in the first fluid-pressure chamber R1 or the second fluid-pressure chamber R2. Specifically, the first sealing member 11*a* and the second sealing member 11*b* are biased toward the low-pressure chamber R4 respectively by the pressures from the first fluid-pressure chamber R1 and the second fluid-pressure chamber R2. As a result, the magnitude relationship between the pressures on both sides of the first sealing member 11*a* and the second sealing member 11*b* in the circumferential direction is prevented from being changed. Thus, the sealing members 11*a* and 11*b* can be prevented from moving inside the sealing grooves 941 and 942 to suppress damage to the sealing members 11*a* and 11*b* and the sealing grooves 941 and 942. The delivery pressures are only required to be introduced at least temporarily to the first fluid-pressure chamber R1 and the second fluid-pressure chamber R2, and the delivery pressures are not necessarily required to be constantly introduced into the first fluid-pressure chamber R1 and the second fluid-pressure chamber R2. Further, when a high-strength material is used as countermeasures against the cavitation erosion, costs are increased. With the sealing structure described above, however, the cavitation erosion is suppressed. Thus, a low-cost material can be used. Both of the pressure in the first fluid-pressure chamber R1 and the pressure in the second fluid-pressure chamber R2 may be controlled, or any one thereof may be controlled.

(2-(2)) In the variable displacement vane pump according to Item (1-(1)), the low-pressure chamber R4 is connected, through the communication path 439, to the intake region of the pump housing, into which the intake pressure is introduced. Therefore, the pressure in the low-pressure chamber R4 can be set as the intake pressure. Thus, stability of the first sealing member 11*a* and the second sealing member 11*b* can be improved.

(3-(3)) In the variable displacement vane pump according to Item (2-(2)), the pump housing includes the pressure plate 41 provided inside the pump-element housing portion so as to be opposed to the cam ring 8 and the rotor 6 in the axial direction, which is the direction of the rotation axis of the driving shaft 5. The pressure plate 41 includes: the delivery port 44 through which the delivery pressure delivered opposite to the cam ring 8 with respect to the pressure plate 41 in the axial direction is introduced to bias the pressure plate 41 toward the cam ring 8; and the intake port 43 formed through the pressure plate 41 on the side opposed to the cam ring 8 so as to have the opening in the intake region. The communication path 439 is a groove having the opening on the pressure plate 41 side, which is opposed to the cam ring 8, and is formed so as to connect the low-pressure chamber R4 and the intake port 43 to each other. Therefore, the communication path 439 can be formed with a simple structure and a small length.

(4-(4)) In the variable displacement vane pump according to Item (3-(3)), the pressure plate 41 is made of a sintered material by the die molding, and the communication path 439 is formed by using the same molding die as a molding die for the pressure plate 41. Thus, a processing step for the communication path 439 can be omitted.

(5-(8)) In the variable displacement vane pump according to Item (1-(1)), the first sealing groove 941 is formed on the second fluid-pressure chamber R2 side with respect to the low-pressure chamber R4 in the circumferential direction, the second sealing groove 942 is formed on the first fluid-pressure chamber R1 side with respect to the low-pressure chamber R4 in the circumferential direction. The first sealing member 11*a* is formed so that the length thereof in the radial direction is smaller than the length of a gap between the first sealing groove 941 and the cam ring 8 in the radial direction, and that the length thereof in the circumferential direction is smaller than the length of the first sealing groove 941 in the circumferential direction. The first sealing member 11*a* is biased toward the cam ring 8 in the radial direction and toward the low-pressure chamber R4 in the circumferential direction by introduction of the pressure in the second fluid-pressure chamber R2 into the first sealing groove 941. The second sealing member 11*b* is formed so that the length thereof in the radial direction is smaller than the length of a gap between the second sealing groove 942 and the cam ring 8 in the radial direction, and that the length thereof in the circumferential direction is smaller than the length of the second sealing groove 942 in the circumferential direction. The second sealing member 11*b* is biased toward the cam ring 8 in the radial direction and toward the low-pressure chamber R4 in the circumferential direction by introduction of the pressure in the first fluid-pressure chamber R1 into the second sealing groove 942. Thus, the biasing force can be obtained without providing a biasing member for biasing the first sealing member 11*a* and the second sealing member 11*b*.

(6-(9)) The variable displacement vane pump according to Item (5-(8)) further includes: the first pressure introduction path 941*d* configured to allow communication between the first sealing groove 941 and the second fluid-pressure chamber R2; and the second pressure introduction path 942*d* configured to allow communication between the second sealing groove 942 and the first fluid-pressure chamber R1. Even in a state in which the first sealing member 11*a* is located closer to the second fluid-pressure chamber R2 and the second sealing member 11*b* is located closer to the first fluid-pressure chamber R1, and thus the pressures are not easily introduced into the first sealing groove 941 and the second sealing groove 942, the pressures can be reliably introduced.

(7-(12)) In the variable displacement vane pump according to Item (1-(1)), each of the first sealing member 11*a* and the second sealing member 11*b* is formed so as to have a generally rectangular sectional shape in the direction orthogonal to an axial direction. The first sealing groove 941 is formed so that the distance between the first low-pressure chamber side wall surface 941*c* on the low-pressure chamber R4 side, which is one of the pair of wall surfaces opposed to each other in the circumferential direction, and the virtual line L1 connecting the middle point of the low-pressure chamber R4 in the circumferential direction and the rotation axis of the driving shaft 5 becomes smaller as a position at which the distance is measured becomes closer to the driving shaft 5. The second sealing groove 942 is formed so that the distance between the second low-pressure chamber side wall surface 942*c* on the low-pressure chamber R4 side, which is one of the pair of wall surfaces opposed to each other in the circumferential direction, and the virtual line L1 connecting the middle point of the low-pressure chamber R4 in the circumferential direction and the rotation axis of the driving shaft 5 becomes smaller as a position at which the distance is measured becomes closer to the driving shaft 5. Therefore, a direction of the contact surfaces of the sealing members 11*a* and 11*b* with the cam ring 8 is located closer to the tangential direction of the cam ring 8. Thus, the sealability of the first sealing member 11*a* and the second sealing member 11*b* can be improved.

(8-(13)) In the variable displacement vane pump according to Item (7-(12)), when the virtual line connecting a center point on the inner circumferential surface of the cam ring 8 and the middle point of the low-pressure chamber R4 in the circumferential direction and moving along with movement of the cam ring 8 is defined as the cam-ring virtual center line L3, the first sealing groove 941 and the second sealing groove 942 are formed so that the cam ring 8 is located between the maximum eccentricity position and the minimum eccentricity position when the cam-ring virtual center line L3 passes through the first intersection P1, which is an intersection between the virtual line L21 extending along the first low-pressure chamber side wall surface 941*c* toward the driving shaft 5 and the virtual line L22 extending along the second low-pressure chamber side wall surface 942*c* toward the driving shaft 5. In other words, the first low-pressure chamber side wall surface 941*c* and the second low-pressure chamber side wall surface 942*c* are formed so that the first intersection P1 is present within the region dx through which the cam-ring virtual center line L3 passes. Thus, the maximum value of the relative angle at the position at which each of the first sealing member 11*a* and the second sealing member 11*b* and the cam ring 8 come into contact with each other can be reduced when the cam ring 8 is located in the minimum eccentricity position or the maximum eccentricity position. Thus, the partial contact of the first sealing member 11*a* and the second sealing member 11*b* can be suppressed.

(9-(14)) The variable displacement vane pump includes: the pump housing including the pump-element housing portion; the driving shaft 5 rotatably supported by the pump housing; the rotor 6 provided inside the pump housing so as to be rotationally driven by the driving shaft 5, the rotor 6 including the plurality of slots 61 arranged in the circumferential direction, which is the direction about the rotation axis of the driving shaft 5; the plurality of vanes 7 provided in the plurality of slots 61 so as to be projectable therefrom and retractable therein; the cam ring 8 formed so as to have an annular shape, the cam ring 8 being provided so as to be movable inside the pump-element housing portion, the cam ring 8 forming the plurality of pump chambers on the inner circumferential side in cooperation with the rotor 6 and the plurality of vanes 7; the intake port 43 formed in the pump housing, the intake port 43 having the opening in the intake region, in which the volumes of the plurality of pump chambers r increase along with the rotation of the rotor 6; the delivery port 44 having the opening in the delivery region, in which the volumes of the plurality of pump chambers r decrease along with the rotation of the rotor 6; the pair of sealing grooves formed on the pump-element housing portion so as to have the openings oriented toward the outer circumferential surface of the cam ring 8 in the radial direction, which is the radiation direction of the rotation axis of the driving shaft 5, the pair of sealing grooves being the first sealing groove 941 and the second sealing groove 942 formed on the intake port 43 side with respect to the driving shaft 5 so as to be separated away from each other in the circumferential direction; the pair of sealing members which are the first sealing member 11*a* provided in the first sealing groove 941 and the second sealing member 11*b* provided in the second sealing groove 942; the pair of pressure chambers formed between the pump-element housing portion and the cam ring 8 in the radial direction so as to be separated by the first sealing member 11*a* and the second sealing member 11*b*, the pair of pressure chambers being: (i) the first fluid-pressure chamber R1 formed on the side on which the volume thereof decreases when the cam ring 8 moves to the side on which the eccentricity of the cam ring 8 increases, the first fluid-pressure chamber R1 being configured such that the delivery pressure delivered through the delivery port 44 is introduced; and (ii) the second fluid-pressure chamber R2 provided on the side on which the volume thereof increases when the cam ring 8 moves to the side on which the eccentricity of the cam ring 8 increases, the second fluid-pressure chamber R2 being configured such that the delivery pressure delivered through the delivery port 44 is introduced; the control valve 30 configured to control the pressure in the first fluid-pressure chamber R1 or the second fluid-pressure chamber R2; and the low-pressure chamber R4, which is the pressure chamber formed between the first sealing member 11*a* and the second sealing member 11*b* in the circumferential direction, the low-pressure chamber R4 being configured such that the working fluid at the intake pressure is introduced. Specifically, the first sealing member 11*a* and the second sealing member 11*b* are biased toward the low-pressure chamber R4 respectively by the pressures from the first fluid-pressure chamber R1 and the second fluid-pressure chamber R2. As a result, the magnitude relationship between the pressures on both sides of the first sealing member 11*a* and the second sealing member 11*b* in the circumferential direction is prevented from being changed. Thus, the sealing members 11*a* and 11*b* can be prevented from moving inside the sealing grooves 941 and 942 to suppress damage to the sealing members 11*a* and 11*b* and the sealing grooves 941 and 942.

(10-(15)) In the variable displacement vane pump according to Item (9-(14)), the low-pressure chamber R4 is connected, through the communication path 439, to the intake region of the pump housing, into which the intake pressure is introduced. Therefore, the pressure in the low-pressure chamber R4 can be set as the intake pressure. Thus, stability of the first sealing member 11*a* and the second sealing member 11*b* can be improved.

(11-(16)) In the variable displacement vane pump according to Item (10-(15)), the pump housing includes the pressure plate 41 provided inside the pump-element housing portion so as to be opposed to the cam ring 8 and the rotor 6 in the axial direction, which is the direction of the rotation axis of the driving shaft 5 The pressure plate 41 includes: the delivery port 44 through which the delivery pressure delivered opposite to the cam ring 8 with respect to the pressure plate 41 in the axial direction is introduced to bias the pressure plate 41 toward the cam ring 8; and the intake port 43 formed through the pressure plate 41 on the side opposed to the cam ring 8 so as to have the opening in the intake region. The communication path 439 is the groove having the opening on the pressure plate 41 side, which is opposed to the cam ring 8, and is formed so as to connect the low-pressure chamber R4 and the intake port 43 to each other. Therefore, the communication path 439 can be formed with a simple structure and a small length.

(12-(17)) In the variable displacement vane pump according to Item (11-(16)), the pressure plate 41 is made of the sintered material by die molding, and the communication path 439 is formed by using the same molding die as the molding die for the pressure plate 41. Thus, processing step for the communication path 439 can be omitted.

(13-(20)) The variable displacement vane pump includes: the pump housing including the pump-element housing portion; the driving shaft 5 rotatably supported by the pump housing; the rotor 6 provided inside the pump housing so as to be rotationally driven by the driving shaft 5, the rotor 6 including the plurality of slots 61 arranged in the circumferential direction, which is the direction about the rotation axis of the driving shaft 5; the plurality of vanes 7 provided in the plurality of slots 61 so as to be projectable therefrom and retractable therein; the cam ring 8 being formed so as to have an annular shape, the cam ring 8 provided so as be movable inside the pump-element housing portion, the cam ring 8 forming the plurality of pump chambers on the inner circumferential side in cooperation with the rotor 6 and the plurality of vanes 7; the intake port 43 formed in the pump housing, the intake port 43 having the opening in the intake region, in which the volumes of the plurality of pump chambers r increase along with the rotation of the rotor 6; the delivery port 44 having the opening in the delivery region, in which the volumes of the plurality of pump chambers r decrease along with the rotation of the rotor 6; the pair of sealing grooves formed on the pump-element housing portion so as to have the openings oriented toward the outer circumferential surface of the cam ring 8 in the radial direction, which is the radiation direction of the rotation axis of the driving shaft 5, the pair of sealing grooves being the first sealing groove 941 and the second sealing groove 942 formed on the intake port 43 side with respect to the driving shaft 5 so as to be separated away from each other in the circumferential direction; the pair of sealing members which are the first sealing member 11*a* provided in the first sealing groove 941 and the second sealing member 11*b* provided in the second sealing groove 942; the pair of pressure chambers formed between the pump-element housing portion and the cam ring 8 in the radial direction so as to be separated by the first sealing member 11*a* and the second sealing member 11*b*, the pair of pressure chambers being: (i) the first fluid-pressure chamber R1 formed on the side on which the volume thereof decreases when the cam ring 8 moves to the side on which the eccentricity of the cam ring 8 increases, the first fluid-pressure chamber R1 being configured such that the delivery pressure delivered through the delivery port 44 is introduced; and (ii) the second fluid-pressure chamber R2 provided on the side on which the volume thereof increases when the cam ring 8 moves to the side on which the eccentricity of the cam ring 8 increases, the second fluid-pressure chamber R2 being configured such that the delivery pressure delivered through the delivery port 44 is introduced; and the control valve 30 configured to control the pressure in the first fluid-pressure chamber R1 or the second fluid-pressure chamber R2. Specifically, both circumferential sides of each of the first sealing member and the second sealing member are not adjacent to both of the first fluid-pressure chamber R1 and the second fluid-pressure chamber R2. Therefore, the movement of the first and second sealing members, which is caused along with a change in pressure in the first fluid-pressure chamber R1 or the second fluid-pressure chamber R2 along with a vibration of the cam ring 8, is suppressed to prevent the sealing members and the sealing grooves from being damaged.

Second Embodiment

Figure 7:
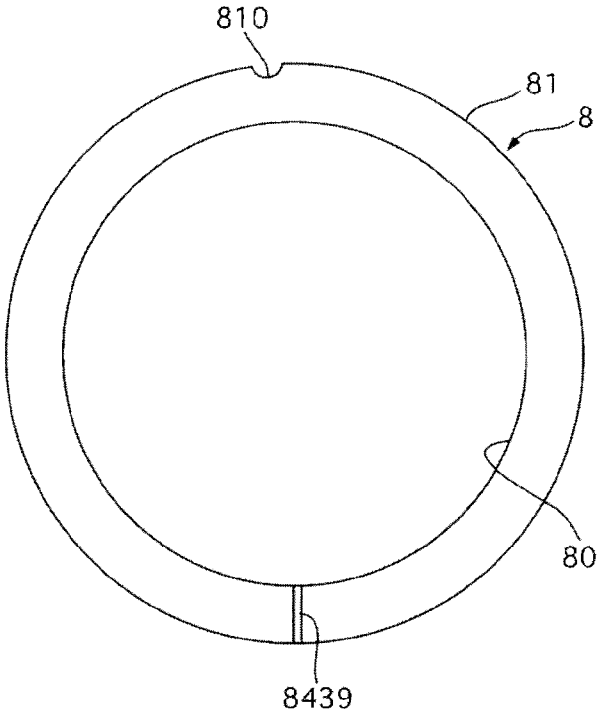
FIG. 7 is a front view illustrating a configuration of a cam ring according to a second embodiment of the present invention.

Next, a second embodiment of the present invention is described. A basic configuration is the same as that in the first embodiment, and therefore only different points are described. In the first embodiment, the communication path 439 is formed on the pressure plate 41. The second embodiment differs from the first embodiment in that communication paths 8439 are formed on the cam ring 8 side. FIG. 7 is a front view illustrating a configuration of the cam ring 8 according to the second embodiment. The communication paths 8439 are formed on both axial end surfaces of the cam ring 8 so as to connect the low-pressure chamber R4 and the intake port 43 to each other. Although the communication paths 8439 are formed on the both axial sides of the cam ring 8 in the second embodiment, the communication path 8439 may be provided only one axial side. The cam ring 8 is formed of a sintered material by die molding. The communication paths 8439 are formed by using a molding die for the cam ring 8. In other words, the communication paths 8439 can be formed by using the same molding die as that for the cam ring 8. Thus, a processing step for the communication paths 8439 can be omitted. The cam ring 8 swings, and therefore positions of the communication paths 8439 with respect to the adapter ring 9 move along with the swing of the cam ring 8. The communication paths 8439 are formed so as to be constantly located in a region sandwiched between the first sealing member 11*a* and the second sealing member 11*b* regardless of the position to which the cam ring 8 moves by swinging. Thus, the intake pressure is constantly introduced into the low-pressure chamber R4 through the communication paths 8439. Accordingly, a low-pressure state can be stably maintained. As described above, the following functions and effects are obtained in the second embodiment. (14-(5)) In the variable displacement vane pump according to Item (2-(2)), the cam ring 8 is formed of a sintered material by die molding. The communication path 8439 includes communication paths 8439, which are formed so as to have a groove shape on both end surfaces of the cam ring 8 in the axial direction, which is the direction of the rotation axis of the driving shaft 5, so as to connect the low-pressure chamber R4 and the intake port 43 to each other. The communication paths 8439 are formed by using the same molding die as a molding die for the cam ring 8. Therefore, the communication paths 8439 through which the low pressure can be introduced from the both axial sides into the low-pressure chamber R4 can be formed without any processing.

Third Embodiment

Figure 8:
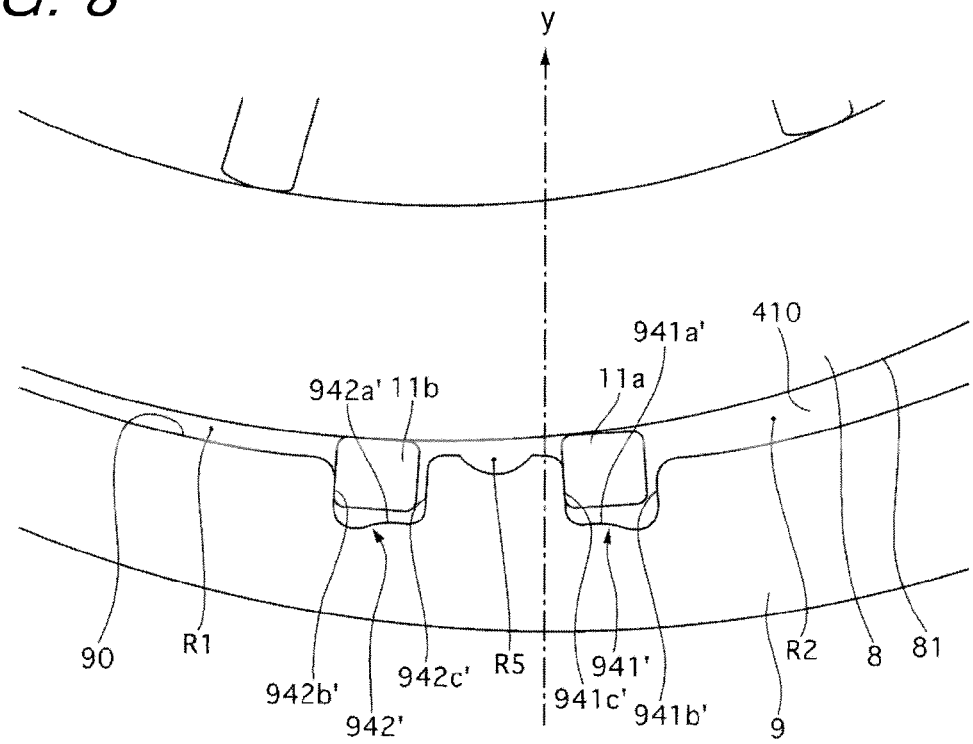
FIG. 8 is an enlarged view of a fourth plane portion according to a third embodiment of the present invention.

Next, a third embodiment of the present invention is described. FIG. 8 is an enlarged view of the fourth plane portion 94 according to the third embodiment. FIG. 8 illustrates a state in which the hydraulic pressure in the second control-pressure chamber R2 is higher than that in the first control-pressure chamber R1. In the first embodiment, the low-pressure chamber R4 is provided between the first sealing member 11*a* and the second sealing member 11*b*. The low-pressure chamber R4 is formed by pressing the first sealing member 11*a* against the first low-pressure chamber side wall portion 941*c* and pressing the second sealing member 11*b* against the second low-pressure chamber side wall portion 942*c*. The third embodiment differs from the first embodiment in that an intermediate-pressure chamber R5 for introducing an intermediate pressure between the hydraulic pressure in the first control-pressure chamber R1 and that in the second control-pressure chamber R2 is provided in place of the low-pressure chamber R4. A first sealing groove 941' is formed on the fourth plane portion 94 of the adapter ring 9 so as to be located on the right of the y axis in FIG. 8 and be concave in the y-axis direction. The first sealing groove 941' includes a bottom portion 941*a*', a first intermediate-pressure chamber side wall portion 941*c*', and a first high-pressure chamber side wall portion 941*b*'. The bottom portion 941*a*' is located on the outermost diameter side in the radial direction. The first intermediate-pressure chamber side wall portion 941*c*' rising from the bottom portion 941*a*' in the positive y-axis direction is provided on the intermediate-pressure chamber R5 side. The first high-pressure chamber side wall portion 941*b*' rising from the bottom portion 941*a*' in the positive y-axis direction is provided on the second control-pressure chamber R2 side. The first sealing member 11*a* is provided in the first sealing groove 941'. The first sealing member 11*a* is formed of the fiber reinforced resin material by die molding. The first sealing member 11*a* is formed so as to have the cuboidal shape with the generally rectangular sectional shape and approximately the same length as the thickness of the cam ring 8 and that of the adapter ring 9 in the z-axis direction. The circumferential length of the first sealing member 11*a* is set so as to be smaller than a circumferential length of the bottom portion 941*a*' of the first sealing groove 941'. In a state in which the first sealing member 11*a* is held in contact with the first intermediate-pressure chamber side wall portion 941*c*', a gap is formed between the first sealing member 11*a* and the first high-pressure chamber side wall portion 941*b*'.

Similarly, a second sealing groove 942' is formed on the fourth plane portion 94 of the adapter ring 9 so as to be located on the left of the y axis in FIG. 8 and be concave in the y-axis direction. The second sealing groove 942' includes a bottom portion 942*a*', a second intermediate-pressure chamber side wall portion 942*c*', and a second high-pressure chamber side wall portion 942*b*'. The bottom portion 942*a*' is located on the outermost diameter side in the radial direction. The second intermediate-pressure chamber side wall portion 942*c*' rising from the bottom portion 942*a*' in the positive y-axis direction is provided on the intermediate-pressure chamber R5 side. The second high-pressure chamber side wall portion 942*b*' rising from the bottom portion 942*a*' in the positive y-axis direction is provided on the first control-pressure chamber R1 side. The second sealing member 11*b* is provided in the second sealing groove 942'. The second sealing member 11*b* is formed of the fiber reinforced resin material by die molding. The second sealing member 11*b* is formed so as to have the cuboidal shape with the generally rectangular sectional shape and approximately the same length as the thickness of the cam ring 8 and that of the adapter ring 9 in the z-axis direction. The circumferential length of the second sealing member 11*b* is set so as to be smaller than a circumferential length of the bottom portion 942*a*' of the second sealing groove 942'. In a state in which the second sealing member 11*b* is held in contact with the second high-pressure chamber side wall portion 942*b*', a gap is formed between the second sealing member 11*b* and the second intermediate-pressure chamber side wall portion 942*c*'.

As illustrated in FIG. 8, the intermediate-pressure chamber R5 is formed in a region defined by the first sealing member 11*a*, the second sealing member 11*b*, a portion of the inner circumferential surface 95, which is located between the first sealing groove 941' and the second sealing groove 942', and the outer circumferential surface 81 of the cam ring 8. Into the intermediate-pressure chamber R5, the intermediate pressure between the control pressure supplied to the first control-pressure chamber R1 and that supplied to the second control-pressure chamber R2 is introduced. Therefore, the first sealing member 11*a* and the second sealing member 11*b* are pressed against the outer circumferential surface 81 of the cam ring 8 with the differential pressure between the hydraulic pressure in the first control-pressure chamber R1 and that in the intermediate-pressure chamber R5 or the differential pressure between the hydraulic pressure in the second control-pressure chamber R2 and that in the intermediate-pressure chamber R5. At the same time, the first sealing member 11*a* is pressed against the first intermediate-pressure chamber side wall portion 941*c*', whereas the second sealing member 11*b* is pressed against the second high-pressure chamber side wall portion 942*b*'. Therefore, even if a pressure fluctuation occurs in the first control-pressure chamber R1 or the second control-pressure chamber R2, the differential pressure exerted on the first sealing member 11*a* or the second sealing member 11*b* can be suppressed.

As described above, the following functions and effects are obtained in the third embodiment. (15-(19)) The variable displacement vane pump includes: the pump housing including the pump-element housing portion; the driving shaft 5 rotatably supported by the pump housing; the rotor 6 provided inside the pump housing so as to be rotationally driven by the driving shaft 5, the rotor 6 including the plurality of slots 61 arranged in the circumferential direction, which is the direction about the rotation axis of the driving shaft 5; the plurality of vanes 7 provided in the plurality of slots 61 so as to be projectable therefrom and retractable therein; the cam ring 8 formed so as to have an annular shape, the cam ring 8 being provided so as to be movable inside the pump-element housing portion, the cam ring 8 forming the plurality of pump chambers on the inner circumferential side in cooperation with the rotor 6 and the plurality of vanes 7; the intake port 43 formed in the pump housing, the intake port 43 having the opening in the intake region, in which the volumes of the plurality of pump chambers r increase along with the rotation of the rotor 6; the delivery port 44 having the opening in the delivery region, in which the volumes of the plurality of pump chambers r decrease along with the rotation of the rotor 6; the pair of sealing grooves formed on the pump-element housing portion so as to have the openings oriented toward the outer circumferential surface of the cam ring 8 in the radial direction, which is the radiation direction of the rotation axis of the driving shaft 5, the pair of sealing grooves being the first sealing groove 941' and the second sealing groove 942' formed on the intake port 43 side with respect to the driving shaft 5 so as to be separated away from each other in the circumferential direction; the pair of sealing members which are the first sealing member 11*a* provided in the first sealing groove 941' and the second sealing member 11*b* provided in the second sealing groove 942'; the pair of pressure chambers formed between the pump-element housing portion and the cam ring 8 in the radial direction so as to be separated by the first sealing member 11*a* and the second sealing member 11*b*, the pair of pressure chambers being: (i) the first fluid-pressure chamber R1 formed on the side on which the volume thereof decreases when the cam ring 8 moves to the side on which the eccentricity of the cam ring 8 increases, the first fluid-pressure chamber R1 being configured such that the delivery pressure delivered through the delivery port 44 is introduced; and (ii) the second fluid-pressure chamber R2 provided on the side on which the volume thereof increases when the cam ring 8 moves to the side on which the eccentricity of the cam ring 8 increases, the second fluid-pressure chamber R2 being configured such that the delivery pressure delivered through the delivery port 44 is introduced; the control valve 30 configured to control the pressure in the first fluid-pressure chamber R1 or the second fluid-pressure chamber R2; and the intermediate-pressure chamber, which is the pressure chamber formed between the first sealing member 11*a* and the second sealing member 11*b* in the circumferential direction, the intermediate-pressure chamber being configured such that the working fluid at the intermediate pressure between the pressure in the first fluid-pressure chamber R1 and the pressure in the second fluid-pressure chamber R2 is introduced. Specifically, the first sealing member or the second sealing member is biased toward the intermediate-pressure chamber from any one of the first fluid-pressure chamber side and the second fluid-pressure chamber side, in which the pressure is higher, and is biased toward the other fluid-pressure chamber, in which the pressure is lower, from the intermediate-pressure chamber side. As a result, the magnitude relationship between the pressures on both the circumferential sides of the first sealing member and the second sealing member changes. However, the magnitude relationship changes between the high pressure and the intermediate pressure or between the intermediate pressure and the low pressure instead of changing between the high pressure and the low pressure. Thus, the damage to the sealing members and the sealing grooves can be reduced.

Fourth Embodiment

Figure 9:
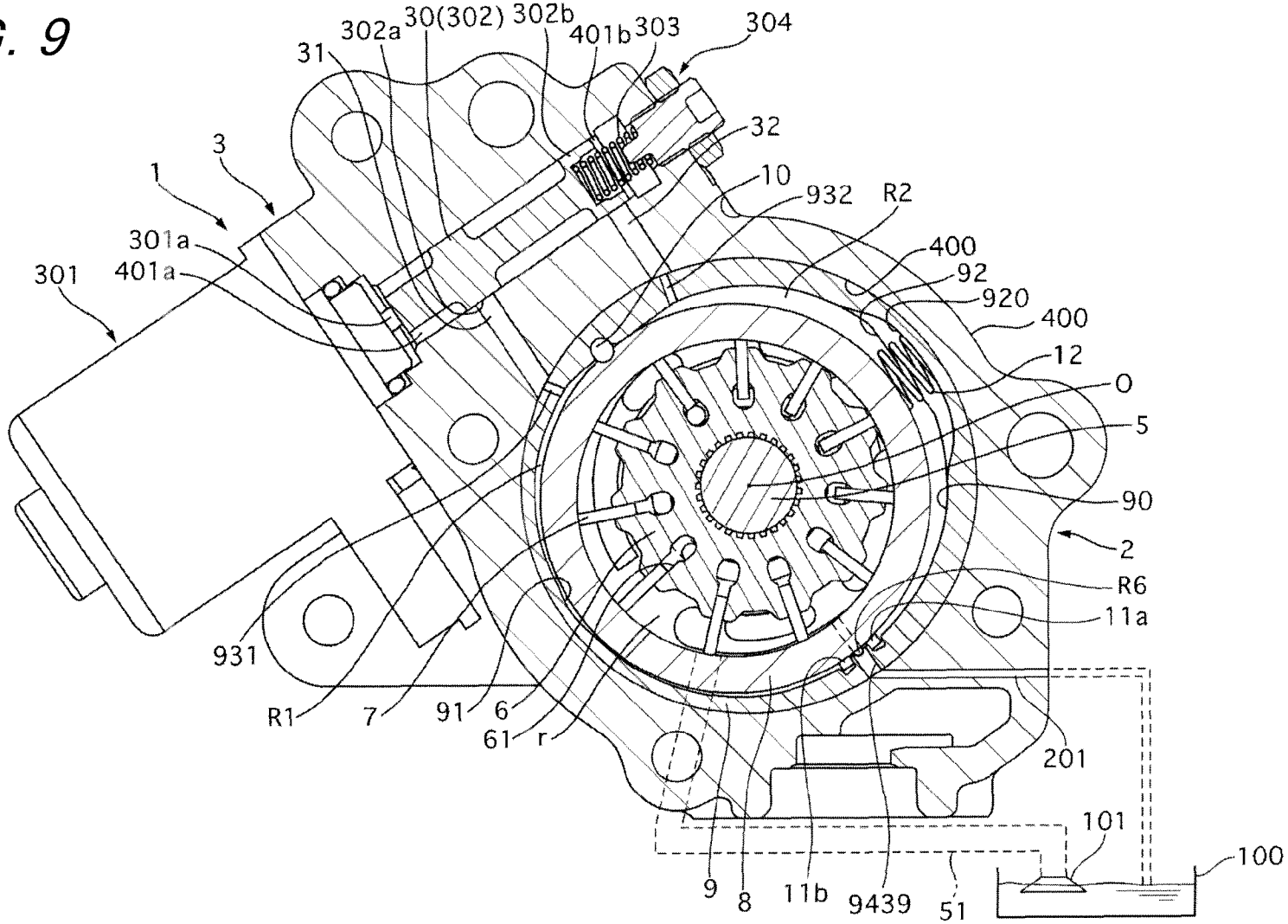
FIG. 9 is a schematic sectional view illustrating a configuration of a variable displacement vane pump according to a fourth embodiment of the present invention.

Next, a fourth embodiment of the present invention is described. FIG. 9 is a schematic sectional view illustrating a configuration of a variable displacement vane pump according to the fourth embodiment. In the first embodiment, the communication path 439 held in communication to the intake-side arc-shaped groove 430 is formed so that the intake pressure is introduced into the low-pressure chamber R4. The fourth embodiment differs from the first embodiment in that a communication path 9439 passing in the radial direction of the adapter ring 9 is formed between the first sealing groove 941 and the second sealing groove 942 of the adapter ring 9. In addition, in the fourth embodiment, an exhaust-oil path 201 for allowing communication between a position on an inner circumference of the housing hole 400, at which the communication path 9439 has an opening, and the exterior of the rear body 40. In this manner, a low-pressure chamber R6 onto which an atmosphere releasing pressure constantly acts is formed. Thus, a pressure in the low-pressure chamber R6 is the atmosphere releasing pressure. Thus, the operating oil leaking from the pump flows into the low-pressure chamber R6 and is also exhausted through the exhaust-oil path 201, to thereby flow back to the oil pan 100 that is provided externally. Then, the operating oil is taken into the pump from the intake port 51 through the strainer 101. As described above, the following functions and effects are obtained in the fourth embodiment.

(16-(6)) In the variable displacement vane pump according to Item (1-(1)), the pump housing has the external communication path for allowing communication between the low-pressure chamber R6 and exterior of the pump housing. Therefore, the pressure in the low-pressure chamber R6 can be set as an atmospheric pressure. Thus, stability of the first sealing member 11*a* and the second sealing member 11*b* can be improved.

(17-(7)) In the variable displacement vane pump according to Item (16-(6)), the external communication path is formed so as to exhaust the hydraulic fluid to the oil pan provided to the exterior of the pump housing, and the hydraulic fluid is taken into the intake port from the oil pan through the strainer. Specifically, when the hydraulic fluid exhausted from the low-pressure chamber is returned to the pump housing, the hydraulic fluid passes through the strainer. Thus, contamination inside the pump housing can be prevented from remaining therein.

Fifth Embodiment

Figure 10:
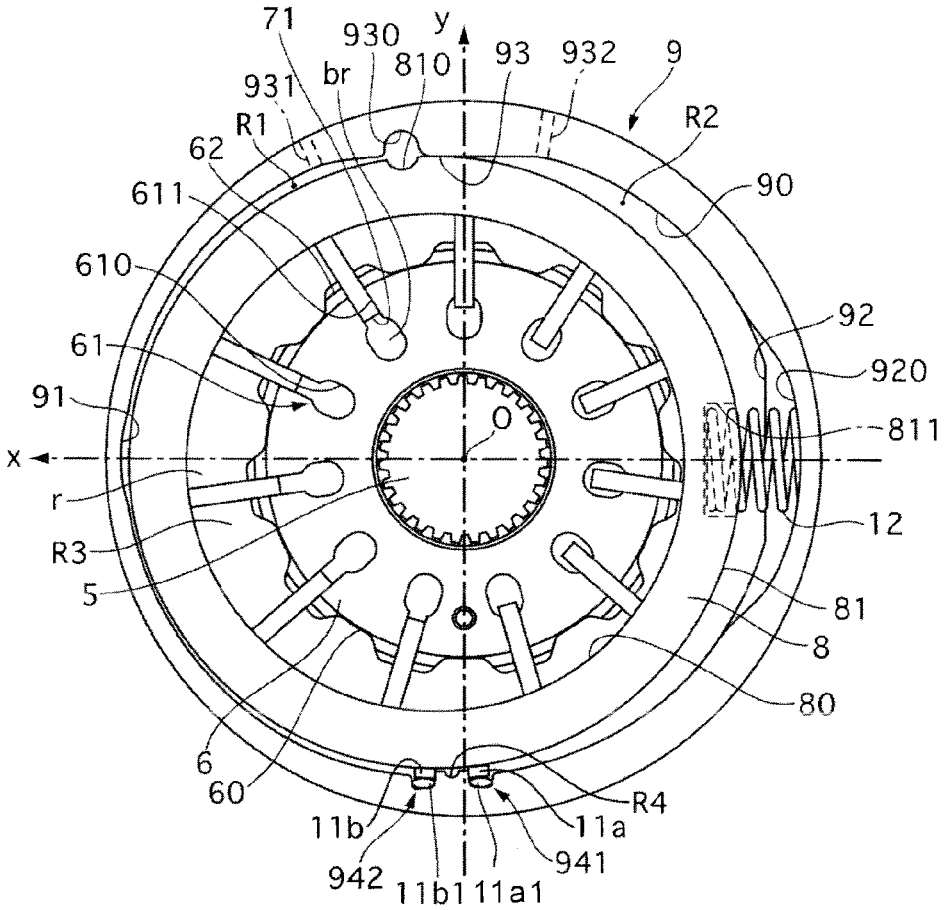
FIG. 10 is a partial enlarged view illustrating an internal configuration of an adapter ring according to a fifth embodiment of the present invention.

Next, a fifth embodiment of the present invention is described. FIG. 10 is a partial enlarged view illustrating an internal configuration of the adapter ring 9 according to the fifth embodiment. In the first embodiment, the first sealing member 11*a* and the second sealing member 11*b* are pressed against the outer circumferential surface 81 of the cam ring 8 by the hydraulic functions of the first control-pressure chamber R1 and the second control-pressure chamber R2. The fifth embodiment differs from the first embodiment in the following. A first biasing member 11*a*1 for biasing the first sealing member 11*a* toward the outer circumferential surface 81 of the cam ring 8 is provided between the first sealing groove 941 and the first sealing member 11*a*. Similarly, a second biasing member 11*b*1 for biasing the second sealing member 11*b* toward the outer circumferential surface 81 of the cam ring 8 is provided between the second sealing groove 942 and the second sealing member 11*b*. Thus, even in a pump operation start initial stage in which the hydraulic pressure is not generated yet in the first control-pressure chamber R1 or the second control-pressure chamber R2, sea ability can be ensured. As described above, the following functions and effects are obtained in the fifth embodiment.

(18-(10)) The variable displacement vane pump according to Item (1-(1)) includes: the first biasing member provided between the first sealing groove 941 and the first sealing member 11*a* in the radial direction, for biasing the first sealing member 11*a* toward the cam ring 8; and the second biasing member provided between the second sealing groove and the second sealing member in the radial direction, for biasing the second sealing member toward the cam ring. Thus, the biasing force can be obtained even in the pump operation start initial stage.

(19-(11)) In the variable displacement vane pump according to Item (18-(10)), each of the first sealing member and the second sealing member is formed of a fiber reinforced resin material by die molding. Specifically, by using the fiber reinforced resin material, a strength of the sealing members can be improved as compared with a case where the reinforcing fiber is not used. Further, by forming the sealing members of the fiber reinforced resin material by using the die molding, the reinforcing fiber is prevented from being exposed on a surface as compared with a case where the sealing members are formed by cutting or the like. Thus, the damage to the sealing grooves due to the reinforcing fiber can be suppressed.

The variable displacement vane pump of the present invention has been described above based on the embodiments. However, the specific configuration of the present invention is not limited to those of the embodiments. A change in design without departing from the scope of the gist of the invention is encompassed in the present invention. For example, the present invention can also be realized as the following embodiment modes.

Embodiment Mode (1)

A variable displacement vane pump includes: a pump housing including a pump-element housing portion;
a driving shaft rotatably supported by the pump housing; a rotor provided inside the pump housing so as to be rotationally driven by the driving shaft, the rotor including a plurality of slots arranged in a circumferential direction, which is a direction about a rotation axis of the driving shaft; a plurality of vanes provided in the plurality of slots so as to be projectable therefrom and retractable therein; a cam ring formed so as to have an annular shape, the cam ring being provided so as to be movable inside the pump-element housing portion, the cam ring forming a plurality of pump chambers on an inner circumferential side in cooperation with the rotor and the plurality of vanes; an intake port formed in the pump housing, the intake port having an opening in an intake region, in which volumes of the plurality of pump chambers increase along with the rotation of the rotor; a delivery port formed in the pump housing, the delivery port having an opening in a delivery region, in which the volumes of the plurality of pump chambers decrease along with the rotation of the rotor; a pair of sealing grooves formed on the pump-element housing portion so as to have openings oriented toward an outer circumferential surface of the cam ring in a radial direction, which is a radiation direction of the rotation axis of the driving shaft, the pair of sealing grooves being a first sealing groove and a second sealing groove formed on the intake port side with respect to the driving shaft so as to be separated away from each other in the circumferential direction; a pair of sealing members which are a first sealing member provided in the first sealing groove and a second sealing member provided in the second sealing groove; a pair of pressure chambers formed between the pump-element housing portion and the cam ring in the radial direction so as to be separated by the first sealing member and the second sealing member, the pair of pressure chambers being: (i) a first fluid-pressure chamber provided on a side on which a volume thereof decreases when the cam ring moves to a side on which an eccentricity of the cam ring increases, the first fluid-pressure chamber being configured such that a delivery pressure delivered through the delivery port is introduced so that a pressure in the first fluid-pressure chamber becomes higher than a pressure in a low-pressure chamber, which is a pressure chamber formed between the first sealing member and the second sealing member; and (ii) a second fluid-pressure chamber provided on a side on which a volume thereof increases when the cam ring moves to a side on which the eccentricity of the cam ring increases, the second fluid-pressure chamber being configured such that the delivery pressure delivered through the delivery port is introduced so that a pressure in the second fluid-pressure chamber becomes higher than the pressure in the low-pressure chamber; and a control valve configured to control the pressure in the first fluid-pressure chamber or the second fluid-pressure chamber. The delivery pressures are only required to be introduced at least temporarily to the first fluid-pressure chamber and the second fluid-pressure chamber, and the delivery pressures are not necessarily required to be constantly introduced into the first fluid-pressure chamber and the second fluid-pressure chamber. Both of the pressure in the first fluid-pressure chamber and the pressure in the second fluid-pressure chamber may be controlled, or any one thereof may be controlled. According to Embodiment Mode (1), the first sealing member and the second sealing member are biased toward the low-pressure chamber respectively by the pressures from the first fluid-pressure chamber and the second fluid-pressure chamber. As a result, the magnitude relationship between the pressures on both sides of the first sealing member and the second sealing member in the circumferential direction is prevented from being changed. Thus, the sealing members can be prevented from moving inside the sealing grooves to suppress damage to the sealing members and the sealing grooves.

Embodiment Mode (2)

In a variable displacement vane pump according to Embodiment Mode (1), the low-pressure chamber is connected, through a communication path, to the intake region of the pump housing, into which an intake pressure is introduced. According to Embodiment Mode (2), the pressure in the low-pressure chamber can be set as the intake pressure. Thus, stability of the first sealing member and the second sealing member can be improved.

Embodiment Mode (3)

In a variable displacement vane pump according to Embodiment Mode (2), the pump housing includes a pressure plate provided inside the pump-element housing portion so as to be opposed to the cam ring and the rotor in an axial direction, which is a direction of the rotation axis of the driving shaft. The pressure plate includes: the delivery port through which the delivery pressure delivered opposite to the cam ring with respect to the pressure plate in the axial direction is introduced to bias the pressure plate toward the cam ring; and the intake port formed through the pressure plate on a side opposed to the cam ring so as to have an opening in the intake region. The communication path is a groove having an opening on the pressure plate side, which is opposed to the cam ring, and is formed so as to connect the low-pressure chamber and the intake port to each other. According to Embodiment Mode (3), the communication path can be formed with a simple structure and a small length.

Embodiment Mode (4)

In a variable displacement vane pump according to Embodiment Mode (3), the pressure plate is made of a sintered material by die molding. The communication path is formed by using the same molding die as a molding die for the pressure plate. According to Embodiment Mode (4), a processing step for the communication path can be omitted.

Embodiment Mode (5)

In a variable displacement vane pump according to Embodiment Mode (2), the cam ring is formed of a sintered material by die molding. The communication path includes communication paths, which are formed so as to have a groove shape on both end surfaces of the cam ring in an axial direction, which is a direction of the rotation axis of the driving shaft, so as to connect the low-pressure chamber and the intake port to each other. The communication paths are formed by using the same molding die as a molding die for the cam ring. According to Embodiment Mode (5), the communication paths through which the low pressure can be introduced from the both axial sides into the low-pressure chamber can be formed without any processing.

Embodiment Mode (6)

In a variable displacement vane pump according to Embodiment Mode (1), the pump housing has an external communication path configured to allow communication between the low-pressure chamber and exterior of the pump housing. According to Embodiment Mode (6), the pressure in the low-pressure chamber can be set as an atmospheric pressure. Thus, stability of the first sealing member and the second sealing member can be improved.

Embodiment Mode (7)

In a variable displacement vane pump according to Embodiment Mode (6), the external communication path is formed so as to exhaust hydraulic fluid to an oil pan provided to the exterior of the pump housing. The hydraulic fluid is taken into the intake port from the oil pan through a strainer. According to Embodiment Mode (7), when the hydraulic fluid exhausted from the low-pressure chamber is returned to the pump housing, the hydraulic fluid passes through the strainer. Thus, contamination inside the pump housing can be prevented from remaining therein.

Embodiment Mode (8)

In a variable displacement vane pump according to Embodiment Mode (1), the first sealing groove is formed on the first fluid-pressure chamber side with respect to the low-pressure chamber in the circumferential direction, and the second sealing groove is formed on the second fluid-pressure chamber side with respect to the low-pressure chamber in the circumferential direction. The first sealing member is formed so that a length thereof in the radial direction is smaller than a length of a gap between the first sealing groove and the cam ring in the radial direction, and that a length thereof in the circumferential direction is smaller than a length of the first sealing groove in the circumferential direction. The first sealing member is biased toward the cam ring in the radial direction and toward the low-pressure chamber in the circumferential direction by introduction of the pressure in the first fluid-pressure chamber into the first sealing groove. The second sealing member is formed so that a length thereof in the radial direction is smaller than a length of a gap between the second sealing groove and the cam ring in the radial direction, and that a length thereof in the circumferential direction is smaller than a length of the second sealing groove in the circumferential direction. The second sealing member is biased toward the cam ring in the radial direction and toward the low-pressure chamber in the circumferential direction by introduction of the pressure in the second fluid-pressure chamber into the second sealing groove. According to Embodiment Mode (8), the biasing force can be obtained without providing a biasing member for biasing the first sealing member and the second sealing member.

Embodiment Mode (9)

A variable displacement vane pump according to Embodiment Mode (8) further includes: a first pressure introduction path configured to allow communication between the first sealing groove and the first fluid-pressure chamber; and a second pressure introduction path configured to allow communication between the second sealing groove and the second fluid-pressure chamber. According to Embodiment Mode (9), even in a state in which the first sealing member is located closer to the first fluid-pressure chamber and the second sealing member is located closer to the second fluid-pressure chamber, and thus the pressures are not easily introduced into the first sealing groove and the second sealing groove, the pressures can be reliably introduced.

Embodiment Mode (10)

A variable displacement vane pump according to Embodiment Mode (1) further includes: a first biasing member provided between the first sealing groove and the first sealing member in the radial direction, for biasing the first sealing member toward the cam ring; and a second biasing member provided between the second sealing groove and the second sealing member in the radial direction, for biasing the second sealing member toward the cam ring. According to Embodiment Mode (10), the biasing force can be obtained even in a pump operation start initial stage.

Embodiment Mode (11)

In a variable displacement vane pump according to Embodiment Mode (10), each of the first sealing member and the second sealing member is formed of a fiber reinforced resin material by die molding. According to Embodiment Mode (11), by using the fiber reinforced resin material, a strength of the sealing members can be improved as compared with a case where the reinforcing fiber is not used. Further, by forming the sealing members of the fiber reinforced resin material by using the die molding, the reinforcing fiber is prevented from being exposed on a surface as compared with a case where the sealing members are formed by cutting or the like. Thus, the damage to the sealing grooves due to the reinforcing fiber can be suppressed.

Embodiment Mode (12)

In a variable displacement vane pump according to Embodiment Mode (1), each of the first sealing member and the second sealing member is formed so as to have a generally rectangular sectional shape in a direction orthogonal to an axial direction. The first sealing groove is formed so that a distance between a first low-pressure chamber side wall surface on the low-pressure chamber side, which is one of a pair of wall surfaces opposed to each other in the circumferential direction, and a virtual line connecting a middle point of the low-pressure chamber in the circumferential direction and the rotation axis of the driving shaft becomes smaller as a position at which the distance is measured becomes closer to the driving shaft. The second sealing groove is formed so that a distance between a second low-pressure chamber side wall surface on the low-pressure chamber side, which is one of a pair of wall surfaces opposed to each other in the circumferential direction, and the virtual line connecting the middle point of the low-pressure chamber in the circumferential direction and the rotation axis of the driving shaft becomes smaller as a position at which the distance is measured becomes closer to the driving shaft. According to Embodiment Mode (12), a direction of the contact surfaces of the sealing members with the cam ring is located closer to the tangential direction of the cam ring. Thus, the sealability of the first sealing member and the second sealing member can be improved.

Embodiment Mode (13)

In a variable displacement vane pump according to Embodiment Mode (12), when a virtual line connecting a center point on an inner circumferential surface of the cam ring and the middle point of the low-pressure chamber in the circumferential direction and moving along with movement of the cam ring is defined as a cam-ring virtual center line, the first sealing groove and the second sealing groove are formed so that the cam ring is located between a maximum eccentricity position and a minimum eccentricity position when the cam-ring virtual center line passes through an intersection between a virtual line extending along the first low-pressure chamber side wall surface toward the driving shaft and a virtual line extending along the second low-pressure chamber side wall surface toward the driving shaft. According to Embodiment Mode (13), the maximum value of the relative angle at the position at which each of the first sealing member and the second sealing member and the cam ring come into contact with each other can be reduced when the cam ring is located in the minimum eccentricity position or the maximum eccentricity position. Thus, the partial contact of the first sealing member and the second sealing member can be suppressed.

Embodiment Mode (14)

A variable displacement vane pump includes: a pump housing including a pump-element housing portion; a driving shaft rotatably supported by the pump housing; a rotor provided inside the pump housing so as to be rotationally driven by the driving shaft, the rotor including a plurality of slots arranged in a circumferential direction, which is a direction about a rotation axis of the driving shaft; a plurality of vanes provided in the plurality of slots so as to be projectable therefrom and retractable therein; a cam ring formed so as to have an annular shape, the cam ring being provided so as to be movable inside the pump-element housing portion, the cam ring forming a plurality of pump chambers on an inner circumferential side in cooperation with the rotor and the plurality of vanes; an intake port formed in the pump housing, the intake port having an opening in an intake region, in which volumes of the plurality of pump chambers increase along with the rotation of the rotor; a delivery port formed in the pump housing, the delivery port having an opening in a delivery region, in which the volumes of the plurality of pump chambers decrease along with the rotation of the rotor; a pair of sealing grooves formed on the pump-element housing portion so as to have openings oriented toward an outer circumferential surface of the cam ring in a radial direction, which is a radiation direction of the rotation axis of the driving shaft, the pair of sealing grooves being a first sealing groove and a second sealing groove formed on the intake port side with respect to the driving shaft so as to be separated away from each other in the circumferential direction; a pair of sealing members which are a first sealing member provided in the first sealing groove and a second sealing member provided in the second sealing groove; a pair of pressure chambers formed between the pump-element housing portion and the cam ring in the radial direction so as to be separated by the first sealing member and the second sealing member, the pair of pressure chambers being: (i) a first fluid-pressure chamber provided on a side on which a volume thereof decreases when the cam ring moves to a side on which an eccentricity of the cam ring increases, the first fluid-pressure chamber being configured such that a delivery pressure delivered through the delivery port is introduced; and (ii) a second fluid-pressure chamber provided on a side on which a volume thereof increases when the cam ring moves to a side on which the eccentricity of the cam ring increases, the second fluid-pressure chamber being configured such that the delivery pressure delivered through the delivery port is introduced; a control valve configured to control a pressure in the first fluid-pressure chamber or the second fluid-pressure chamber; and a low-pressure chamber, which is a pressure chamber formed between the first sealing member and the second sealing member in the circumferential direction, the low-pressure chamber being configured such that hydraulic fluid at an intake pressure is introduced. According to Embodiment Mode (14), the first sealing member and the second sealing member are biased toward the low-pressure chamber respectively by the pressures from the first control-pressure chamber and the second control-pressure chamber. As a result, the magnitude relationship between the pressures on both sides of the first sealing member and the second sealing member in the circumferential direction is prevented from being changed. Thus, the sealing members can be prevented from moving inside the sealing grooves to suppress damage to the sealing members and the sealing grooves.

Embodiment Mode (15)

In a variable displacement vane pump according to Embodiment Mode (14), the low-pressure chamber is connected, through a communication path, to the intake region of the pump housing, into which an intake pressure is introduced. According to Embodiment Mode (15), the pressure in the low-pressure chamber can be set as the intake pressure with a simple structure. Thus, stability of the first sealing member and the second sealing member can be improved.

Embodiment Mode (16)

In a variable displacement vane pump according to Embodiment Mode (15), the pump housing includes a pressure plate provided inside the pump-element housing portion so as to be opposed to the cam ring and the rotor in an axial direction, which is a direction of the rotation axis of the driving shaft. The pressure plate includes: the delivery port through which the delivery pressure delivered opposite to the cam ring with respect to the pressure plate in the axial direction is introduced to bias the pressure plate toward the cam ring; and the intake port formed through the pressure plate on a side opposed to the cam ring so as to have an opening in the intake region. The communication path is a groove having an opening on the pressure plate side, which is opposed to the cam ring, and is formed so as to connect the low-pressure chamber and the intake port to each other. According to Embodiment Mode (16), the communication path can be formed with a simple structure and a small length.

Embodiment Mode (17)

In a variable displacement vane pump according to Embodiment Mode (16), the pressure plate is made of a sintered material by die molding. The communication path is formed by using the same molding die as a molding die for the pressure plate.

Embodiment Mode (18)

In a variable displacement vane pump according to Embodiment Mode (15), the cam ring is formed of a sintered material by die molding. The communication path includes communication paths, which are formed so as to have a groove shape on both end surfaces of the cam ring in an axial direction, which is a direction of the rotation axis of the driving shaft, so as to connect the low-pressure chamber and the intake port to each other. The communication paths are formed by using the same molding die as a molding die for the cam ring. According to Embodiment Mode (18), the communication paths through which the low pressure can be introduced from the both axial sides into the low-pressure chamber can be formed without any processing.

Embodiment Mode (19)

A variable displacement vane pump includes: a pump housing including a pump-element housing portion; a driving shaft rotatably supported by the pump housing; a rotor provided inside the pump housing so as to be rotationally driven by the driving shaft, the rotor including a plurality of slots arranged in a circumferential direction, which is a direction about a rotation axis of the driving shaft; a plurality of vanes provided in the plurality of slots so as to be projectable therefrom and retractable therein; a cam ring formed so as to have an annular shape, the cam ring being provided so as to be movable inside the pump-element housing portion, the cam ring forming a plurality of pump chambers on an inner circumferential side in cooperation with the rotor and the plurality of vanes; an intake port formed in the pump housing, the intake port having an opening in an intake region, in which volumes of the plurality of pump chambers increase along with the rotation of the rotor; a delivery port formed in the pump housing, the delivery port having an opening in a delivery region, in which the volumes of the plurality of pump chambers decrease along with the rotation of the rotor; a pair of sealing grooves formed on the pump-element housing portion so as to have openings oriented toward an outer circumferential surface of the cam ring in a radial direction, which is a radiation direction of the rotation axis of the driving shaft, the pair of sealing grooves being a first sealing groove and a second sealing groove formed on the intake port side with respect to the driving shaft so as to be separated away from each other in the circumferential direction; a pair of sealing members which are a first sealing member provided in the first sealing groove and a second sealing member provided in the second sealing groove; a pair of pressure chambers formed between the pump-element housing portion and the cam ring in the radial direction so as to be separated by the first sealing member and the second sealing member, the pair of pressure chambers being: (i) a first fluid-pressure chamber provided on a side on which a volume thereof decreases when the cam ring moves to a side on which an eccentricity of the cam ring increases, the first fluid-pressure chamber being configured such that a delivery pressure delivered through the delivery port is introduced; and (ii) a second fluid-pressure chamber provided on a side on which a volume thereof increases when the cam ring moves to a side on which the eccentricity of the cam ring increases, the second fluid-pressure chamber being configured such that the delivery pressure delivered through the delivery port is introduced; a control valve configured to control a pressure in the first fluid-pressure chamber or the second fluid-pressure chamber; and an intermediate-pressure chamber, which is a pressure chamber formed between the first sealing member and the second sealing member in the circumferential direction, the intermediate-pressure chamber being configured such that hydraulic fluid at an intermediate pressure between the pressure in the first fluid-pressure chamber and the pressure in the second fluid-pressure chamber is introduced. According to Embodiment Mode (19), when the pressure between the sealing members becomes the intermediate pressure, the sealing members move toward the intermediate pressure when the pressures are respectively high and intermediate, and move toward the low pressure when the pressures are respectively intermediate and low. If the magnitude relationship between the pressures in the fluid-pressure chambers changes in this state, the high pressure becomes low while the low pressure becomes high. Thus, the sealing members respectively move to the intermediate pressure side and the low pressure side. Although both the high pressure and the low pressure are applied to the single sealing member, the differential pressure between the high pressure and the intermediate pressure or between the intermediate pressure and the low pressure can be set smaller than that between the high pressure and the low pressure. Therefore, the damage to the sealing members and the sealing grooves can be suppressed.

Embodiment Mode (20)

A variable displacement vane pump includes: a pump housing including a pump-element housing portion; a driving shaft rotatably supported by the pump housing; a rotor provided inside the pump housing so as to be rotationally driven by the driving shaft, the rotor including a plurality of slots arranged in a circumferential direction, which is a direction about a rotation axis of the driving shaft; a plurality of vanes provided in the plurality of slots so as to be projectable therefrom and retractable therein; a cam ring formed so as to have an annular shape, the cam ring being provided so as to be movable inside the pump-element housing portion, the cam ring forming a plurality of pump chambers on an inner circumferential side in cooperation with the rotor and the plurality of vanes; an intake port formed in the pump housing, the intake port having an opening in an intake region, in which volumes of the plurality of pump chambers increase along with the rotation of the rotor; a delivery port formed in the pump housing, the delivery port having an opening in a delivery region, in which the volumes of the plurality of pump chambers decrease along with the rotation of the rotor; a pair of sealing grooves formed on the pump-element housing portion so as to have openings oriented toward an outer circumferential surface of the cam ring in a radial direction, which is a radiation direction of the rotation axis of the driving shaft, the pair of sealing grooves being a first sealing groove and a second sealing groove formed on the intake port side with respect to the driving shaft so as to be separated away from each other in the circumferential direction; a pair of sealing members which are a first sealing member provided in the first sealing groove and a second sealing member provided in the second sealing groove; a pair of pressure chambers formed between the pump-element housing portion and the cam ring in the radial direction so as to be separated by the first sealing member and the second sealing member, the pair of pressure chambers being: (i) a first fluid-pressure chamber provided on a side on which a volume thereof decreases when the cam ring moves to a side on which an eccentricity of the cam ring increases, the first fluid-pressure chamber being configured such that a delivery pressure delivered through the delivery port is introduced; and (ii) a second fluid-pressure chamber provided on a side on which a volume thereof increases when the cam ring moves to a side on which the eccentricity of the cam ring increases, the second fluid-pressure chamber being configured such that the delivery pressure delivered through the delivery port is introduced; and a control valve configured to control a pressure in the first fluid-pressure chamber or the second fluid-pressure chamber. According to Embodiment Mode (20), both circumferential sides of each of the first sealing member and the second sealing member are not adjacent to both of the first fluid-pressure chamber and the second fluid-pressure chamber. Therefore, the movement of the first and second sealing members, which is caused along with a change in pressure in the first fluid-pressure chamber or the second fluid-pressure chamber along with a vibration of the cam ring, is suppressed to prevent the sealing members and the sealing grooves from being damaged.

Although only some exemplary embodiments of this invention have been described in detail above, those skilled in the art will readily appreciate that many modifications are possible in the exemplary embodiments without materially departing from the novel teaching and advantages of this invention. Accordingly, all such modifications are intended to be included within the scope of this invention.

The present application claims priority under 35 U.S.C. section 119 to Japanese Patent Applications No. 2014-052436 filed on Mar. 14, 2014. The entire disclosure of Japanese Patent Application No. 2014-052436 filed on Mar. 14, 2014 including specification, claims, drawings and summary are incorporated herein by reference in its entirety.

What is claimed is:

1. A variable displacement vane pump, comprising:

a pump housing including a pump-element housing portion;

a driving shaft rotatably supported by the pump housing;

a rotor provided inside the pump housing so as to be rotationally driven by the driving shaft, the rotor including a plurality of slots arranged in a circumferential direction, which is a direction about a rotation axis of the driving shaft;

a plurality of vanes provided in the plurality of slots so as to be projectable therefrom and retractable therein;

a cam ring formed so as to have an annular shape, the cam ring being provided so as to be movable inside the pump-element housing portion, the cam ring forming a plurality of pump chambers on an inner circumferential side in cooperation with the rotor and the plurality of vanes;

an intake port formed in the pump housing, the intake port having an opening in an intake region, in which volumes of the plurality of pump chambers increase along with the rotation of the rotor;

a delivery port formed in the pump housing, the delivery port having an opening in a delivery region, in which the volumes of the plurality of pump chambers decrease along with the rotation of the rotor;

a pair of sealing grooves formed on the pump-element housing portion so as to have openings oriented toward an outer circumferential surface of the cam ring in a radial direction, which is a radiation direction of the rotation axis of the driving shaft, the pair of sealing grooves being a first sealing groove and a second sealing groove formed on the intake port side with respect to the driving shaft so as to be separated away from each other in the circumferential direction;

a pair of sealing members which are a first sealing member provided in the first sealing groove and a second sealing member provided in the second sealing groove;

a pair of pressure chambers formed between the pump-element housing portion and the cam ring in the radial direction so as to be separated by the first sealing member and the second sealing member, the pair of pressure chambers being:

a first fluid-pressure chamber provided on a side on which a volume thereof decreases when the cam ring moves to a side on which an eccentricity of the cam ring increases, the first fluid-pressure chamber being configured such that a delivery pressure delivered through the delivery port is introduced so that a pressure in the first fluid-pressure chamber becomes higher than a pressure in a low-pressure chamber, which is a pressure chamber formed between the first sealing member and the second sealing member; and a second fluid-pressure chamber provided on a side on which a volume thereof increases when the cam ring moves to a side on which the eccentricity of the cam ring increases, the second fluid-pressure chamber being configured such that the delivery pressure delivered through the delivery port is introduced so that a pressure in the second fluid-pressure chamber becomes higher than the pressure in the low-pressure chamber; and a control valve configured to control the pressure in the first fluid-pressure chamber or the second fluid-pressure chamber, wherein the low-pressure chamber is connected, through a communication path, to the intake region of the pump housing, into which an intake pressure is introduced, wherein:

the pump housing includes a pressure plate provided inside the pump-element housing portion so as to be opposed to the cam ring and the rotor in an axial direction, which is a direction of the rotation axis of the driving shaft;

the pressure plate includes:

the delivery port through which the delivery pressure delivered opposite to the cam ring with respect to the pressure plate in the axial direction is introduced to bias the pressure plate toward the cam ring; and the intake port formed through the pressure plate on a side opposed to the cam ring so as to have an opening in the intake region; and the communication path is a groove having an opening on the pressure plate side, which is opposed to the cam ring, the communication path being formed so as to connect the low-pressure chamber and the intake port to each other.

2. A variable displacement vane pump according to claim 1, wherein:

the pressure plate is made of a sintered material by die molding; and the communication path is formed by using the same molding die as a molding die for the pressure plate.

3. A variable displacement vane pump according to claim 1, wherein:

the first sealing groove is formed on the first fluid-pressure chamber side with respect to the low-pressure chamber in the circumferential direction;

the second sealing groove is formed on the second fluid-pressure chamber side with respect to the low-pressure chamber in the circumferential direction;

the first sealing member is formed so that a length thereof in the radial direction is smaller than a length of a gap between the first sealing groove and the cam ring in the radial direction, and that a length thereof in the circumferential direction is smaller than a length of the first sealing groove in the circumferential direction;

the first sealing member is biased toward the cam ring in the radial direction and toward the low-pressure chamber in the circumferential direction by introduction of the pressure in the first fluid-pressure chamber into the first sealing groove;

the second sealing member is formed so that a length thereof in the radial direction is smaller than a length of a gap between the second sealing groove and the cam ring in the radial direction, and that a length thereof in the circumferential direction is smaller than a length of the second sealing groove in the circumferential direction; and the second sealing member is biased toward the cam ring in the radial direction and toward the low-pressure chamber in the circumferential direction by introduction of the pressure in the second fluid-pressure chamber into the second sealing groove.

4. A variable displacement vane pump according to claim 3, further comprising:

a first pressure introduction path configured to allow communication between the first sealing groove and the first fluid-pressure chamber; and a second pressure introduction path configured to allow communication between the second sealing groove and the second fluid-pressure chamber.

5. A variable displacement vane pump according to claim 1, wherein:

each of the first sealing member and the second sealing member is formed so as to have a rectangular sectional shape in a direction orthogonal to an axial direction;

the first sealing groove is formed so that a distance between a first low-pressure chamber side wall surface on the low-pressure chamber side, which is one of a pair of wall surfaces opposed to each other in the circumferential direction, and a virtual line connecting a middle point of the low-pressure chamber in the circumferential direction and the rotation axis of the driving shaft becomes smaller as a position at which the distance is measured becomes closer to the driving shaft; and the second sealing groove is formed so that a distance between a second low-pressure chamber side wall surface on the low-pressure chamber side, which is one of a pair of wall surfaces opposed to each other in the circumferential direction, and the virtual line connecting the middle point of the low-pressure chamber in the circumferential direction and the rotation axis of the driving shaft becomes smaller as a position at which the distance is measured becomes closer to the driving shaft.

6. A variable displacement vane pump according to claim 5, wherein, when a virtual line connecting a center point on an inner circumferential surface of the cam ring and the middle point of the low-pressure chamber in the circumferential direction and moving along with movement of the cam ring is defined as a cam-ring virtual center line, the first sealing groove and the second sealing groove are formed so that the cam ring is located between a maximum eccentricity position and a minimum eccentricity position when the cam-ring virtual center line passes through an intersection between a virtual line extending along the first low-pressure chamber side wall surface toward the driving shaft and a virtual line extending along the second low-pressure chamber side wall surface toward the driving shaft.

7. A variable displacement vane pump comprising:

a pump housing including a pump-element housing portion;

a driving shaft rotatably supported by the pump housing;

a rotor provided inside the pump housing so as to be rotationally driven by the driving shaft, the rotor including a plurality of slots arranged in a circumferential direction, which is a direction about a rotation axis of the driving shaft;

a plurality of vanes provided in the plurality of slots so as to be therefrom and retractable therein;

a cam ring formed so as to have an annular shape, the cam ring being provided so as to be movable inside the pump-element housing portion, the cam ring forming a plurality of pump chambers on an inner circumferential side in cooperation with the rotor and the plurality of vanes;

an intake port formed in the pump housing, the intake port having an opening in an intake region, in which volumes of the plurality of pump chambers increase along with the rotation of the rotor;

a delivery port formed in the pump housing, the delivery port having an opening in a delivery region, in which the volumes of the plurality of pump chambers decrease along with the rotation of the rotor;

a pair of sealing grooves formed on the pump-element housing portion so as to have openings oriented toward an outer circumferential surface of the cam ring in a radial direction, which is a radiation direction of the rotation axis of the driving shaft, the pair of sealing grooves being a first sealing groove and a second sealing groove formed on the intake port side with respect to the driving shaft so as to be separated away from each other in the circumferential direction;

a pair of sealing members which are a first sealing member provided in the first sealing groove and a second sealing member provided in the second sealing groove;

a pair of pressure chambers formed between the pump-element housing portion and the cam ring in the radial direction so as to be separated by the first sealing member and the second sealing member, the pair of pressure chambers being:

a first fluid-pressure chamber provided on a side on which a volume thereof decreases when the cam ring moves to a side on which an eccentricity of the cam ring increases, the first fluid-pressure chamber being configured such that a delivery pressure delivered through the delivery port is introduced so that a pressure in the first fluid-pressure chamber becomes higher than a pressure in a low-pressure chamber, which is a pressure chamber formed between the first sealing member and the second sealing member; and a second fluid-pressure chamber provided on a side on which a volume thereof increases when the cam ring moves to a side on which the eccentricity of the cam ring increases, the second fluid-pressure chamber being configured such that the delivery pressure delivered through the delivery port is introduced so that a pressure in the second fluid-pressure chamber becomes higher than the pressure in the low-pressure chamber; and a control valve configured to control the pressure in the first fluid-pressure chamber or the second fluid-pressure chamber, wherein the low-pressure chamber is connected, through a communication path, to the intake region of the pump housing, into which an intake pressure is introduced, wherein:

the cam ring is formed of a sintered material by die molding; and the communication path includes communication paths, which are formed so as to have a groove shape on both end surfaces of the cam ring in an axial direction, which is a direction of the rotation axis of the driving shaft, so as to connect the low-pressure chamber and the intake port to each other, the communication paths being formed by using the same molding die as a molding die for the cam ring.

8. A variable displacement vane pump according to claim 7, wherein:

the pump housing includes a pressure plate;

the pressure plate is made of a sintered material by die molding; and the communication path is formed by using the same molding die as a molding die for the pressure plate.

9. A variable displacement vane pump, comprising:

a pump housing including a pump-element housing portion;

a driving shaft rotatably supported by the pump housing;

a rotor provided inside the pump housing so as to be rotationally driven by the driving shaft, the rotor comprising a plurality of slots arranged in a circumferential direction, which is a direction about a rotation axis of the driving shaft;

a plurality of vanes provided in the plurality of slots so as to be projectable therefrom and retractable therein;

a cam ring formed so as to have an annular shape, the cam ring being provided so as to be movable inside the pump-element housing portion, the cam ring forming a plurality of pump chambers on an inner circumferential side in cooperation with the rotor and the plurality of vanes;

an intake port formed in the pump housing, the intake port having an opening in an intake region, in which volumes of the plurality of pump chambers increase along with the rotation of the rotor;

a delivery port formed in the pump housing, the delivery port having an opening in a delivery region, in which the volumes of the plurality of pump chambers decrease along with the rotation of the rotor;

a pair of sealing grooves formed on the pump-element housing portion so as to have openings oriented toward an outer circumferential surface of the cam ring in a radial direction, which is a radiation direction of the rotation axis of the driving shaft, the pair of sealing grooves being a first sealing groove and a second sealing groove formed on the intake port side with respect to the driving shaft so as to be separated away from each other in the circumferential direction;

a pair of sealing members which are a first sealing member provided in the first sealing groove and a second sealing member provided in the second sealing groove;

a pair of pressure chambers formed between the pump-element housing portion and the cam ring in the radial direction so as to be separated by the first sealing member and the second sealing member, the pair of pressure chambers being:

a first fluid-pressure chamber provided on a side on which a volume thereof decreases when the cam ring moves to a side on which an eccentricity of the cam ring increases, the first fluid-pressure chamber being configured such that a delivery pressure delivered through the delivery port is introduced; and a second fluid-pressure chamber provided on a side on which a volume thereof increases when the cam ring moves to a side on which the eccentricity of the cam ring increases, the second fluid-pressure chamber being configured such that the delivery pressure delivered through the delivery port is introduced;

a control valve configured to control a pressure in the first fluid-pressure chamber or the second fluid-pressure chamber; and a low-pressure chamber, which is a pressure chamber formed between the first sealing member and the second sealing member in the circumferential direction, the low-pressure chamber being configured such that hydraulic fluid at an intake pressure is introduced, wherein the low-pressure chamber is connected, through a communication path, to the intake region of the pump housing, into which the intake pressure is introduced, and wherein:

the pump housing includes a pressure plate provided inside the pump-element housing portion so as to be opposed to the cam ring and the rotor in an axial direction, which is a direction of the rotation axis of the driving shaft;

the pressure plate includes:

the delivery port through which the delivery pressure delivered opposite to the cam ring with respect to the pressure plate in the axial direction is introduced to bias the pressure plate toward the cam ring; and the intake port formed through the pressure plate on a side opposed to the cam ring so as to have an opening in the intake region; and the communication path is a groove having an opening on the pressure plate side, which is opposed to the cam ring, the communication path being formed so as to connect the low-pressure chamber and the intake port to each other.

10. A variable displacement vane pump according to claim 9, wherein:

the pressure plate is made of a sintered material by die molding; and the communication path is formed by using the same molding die as a molding die for the pressure plate.

11. A variable displacement vane pump comprising:

a pump housing including a pump-element housing portion;

a driving shaft rotatably supported by the pump housing;

a rotor provided inside the pump housing so as to be rotationally driven by the driving shaft, the rotor comprising a plurality of slots arranged in a circumferential direction, which is a direction about a rotation axis of the driving shaft;

a plurality of vanes provided in the plurality of slots so as to be projectable therefrom and retractable therein;

a cam ring formed so as to have an annular shape, the cam ring being provided so as to be movable inside the pump-element housing portion, the cam ring forming a plurality of pump chambers on an inner circumferential side in cooperation with the rotor and the plurality of vanes;

an intake port formed in the pump housing, the intake port having an opening in an intake region, in which volumes of the plurality of pump chambers increase along with the rotation of the rotor;

a delivery port formed in the pump housing, the delivery port having an opening in a delivery region, in which the volumes of the plurality of pump chambers decrease along with the rotation of the rotor;

a pair of sealing grooves formed on the pump-element housing portion so as to have openings oriented toward an outer circumferential surface of the cam ring in a radial direction, which is a radiation direction of the rotation axis of the driving shaft, the pair of sealing grooves being a first sealing groove and a second sealing groove formed on the intake port side with respect to the driving shaft so as to be separated away from each other in the circumferential direction;

a pair of sealing members which are a first sealing member provided in the first sealing groove and a second sealing member provided in the second sealing groove;

a pair of pressure chambers formed between the pump-element housing portion and the cam ring in the radial direction so as to be separated by the first sealing member and the second sealing member, the pair of pressure chambers being:

a first fluid-pressure chamber provided on a side on which a volume thereof decreases when the cam ring moves to a side on which an eccentricity of the cam ring increases, the first fluid-pressure chamber being configured such that a delivery pressure delivered through the delivery port is introduced; and a second fluid-pressure chamber provided on a side on which a volume thereof increases when the cam ring moves to a side on which the eccentricity of the cam ring increases, the second fluid-pressure chamber being configured such that the delivery pressure delivered through the delivery port is introduced;

a control valve configured to control a pressure in the first fluid-pressure chamber or the second fluid-pressure chamber; and a low-pressure chamber, which is a pressure chamber formed between the first sealing member and the second sealing member in the circumferential direction, the low-pressure chamber being configured such that hydraulic fluid at an intake pressure is introduced, wherein:

wherein the low-pressure chamber is connected, through a communication path, to the intake region of the pump housing, into which the intake pressure is introduced, wherein:

the cam ring is formed of a sintered material by die molding; and the communication path includes communication paths, which are formed so as to have a groove shape on both end surfaces of the cam ring in an axial direction, which is a direction of the rotation axis of the driving shaft, so as to connect the low-pressure chamber and the intake port to each other, the communication paths being formed by using the same molding die as a molding die for the cam ring.

12. A variable displacement vane pump according to claim 11, wherein:

the pump housing includes a pressure plate;

the pressure plate is made of a sintered material by die molding; and the communication path is formed by using the same molding die as a molding die for the pressure plate.

* * * * *